US005336000A

United States Patent [19]

Handa et al.

[11] Patent Number: 5,336,000

[45] Date of Patent: Aug. 9, 1994

[54] THERMAL TRANSFER TYPE PRINTER AND METHOD OF REJUVENATING AN INK SHEET EMPLOYED IN THE PRINTER

[75] Inventors: Tsuneo Handa; Noriyoshi Chiba; Masanao Kunugi, all of Suwa, Japan

[73] Assignee: Seiko Epson Corporation, Tokyo, Japan

[21] Appl. No.: 71,202

[22] Filed: Jun. 1, 1993

Related U.S. Application Data

[63] Continuation of Ser. No. 671,802, filed as PCT/JP90/00952 Jul. 26, 1990, and published as WO 91/01889 Feb. 21, 1991, abandoned.

[30] Foreign Application Priority Data

| | | | |
|---|---|---|---|
| Jul. 28, 1989 | [JP] | Japan | 1-195849 |
| Jul. 28, 1989 | [JP] | Japan | 1-195850 |
| Jul. 28, 1989 | [JP] | Japan | 1-195851 |
| Jul. 28, 1989 | [JP] | Japan | 1-195852 |
| Jul. 28, 1989 | [JP] | Japan | 1-195853 |
| Jul. 28, 1989 | [JP] | Japan | 1-195854 |
| Jul. 28, 1989 | [JP] | Japan | 1-195855 |
| Jul. 28, 1989 | [JP] | Japan | 1-195856 |
| Jul. 28, 1989 | [JP] | Japan | 1-195857 |
| Jul. 28, 1989 | [JP] | Japan | 1-195858 |
| Jul. 28, 1989 | [JP] | Japan | 1-195859 |
| Aug. 10, 1989 | [JP] | Japan | 1-207379 |
| Aug. 10, 1989 | [JP] | Japan | 1-207380 |

[51] Int. Cl.[5] ..... B41J 31/16

[52] U.S. Cl. ..... 400/197; 400/198; 400/202.2; 400/202.4; 400/54; 427/469; 427/482; 427/141

[58] Field of Search ..... 400/197, 198, 199, 200, 400/201, 202.1–202.4, 54, 225; 346/140 R; 427/141, 466, 469, 482, 486; 118/621

[56] References Cited

U.S. PATENT DOCUMENTS

| | | | |
|---|---|---|---|
| 4,467,332 | 8/1984 | Akutsu | 400/200 |
| 4,467,332 | 7/1984 | Akutsu et al. | 346/140 |
| 4,507,667 | 3/1985 | Tsuboi et al. | 346/76 |
| 5,090,828 | 2/1992 | Shimura et al. | 400/197 |

FOREIGN PATENT DOCUMENTS

| | | | |
|---|---|---|---|
| 3317060.6 | 5/1983 | Fed. Rep. of Germany . | |
| 101076 | 6/1983 | Japan . | |
| 155983 | 9/1983 | Japan . | |
| 181676 | 10/1983 | Japan . | |
| 194591 | 11/1983 | Japan . | |
| 110493 | 6/1985 | Japan . | |
| 259485 | 12/1985 | Japan | 400/198 |
| 44674 | 3/1986 | Japan . | |
| 72574 | 4/1986 | Japan . | |
| 173368 | 10/1986 | Japan . | |
| 161579 | 7/1987 | Japan | 400/198 |
| 111081 | 5/1988 | Japan . | |

*Primary Examiner*—Edgar S. Burr
*Assistant Examiner*—Stephen R. Funk
*Attorney, Agent, or Firm*—W. Douglas Carothers, Jr.

[57] ABSTRACT

A thermal transfer type printer having an ink sheet rejuvenation system and method for rejuvenation of an ink sheet used in the printer wherein the printer has a transport path for transporting the ink sheet past an ink deposition station for selective transfer of powder ink from a powder ink supply to an ink sheet surface when a bias is applied at the station; ink fixing station having fixing applicator for selective engagement with the ink sheet surface for fixing the powder ink to the ink sheet; and a printing station having a thermal print head for engagement of the print head with the ink sheet onto a surface of an output medium for forming images on the output medium by selective thermal transfer of ink to the output medium surface in imagewise formation. The printer incudes a control system for the rejuvenating process to handle the sequence of operation of the ink deposition station, ink fixing station and the printing station of the printer as well as their operation at the time of a power ON condition or a power OFF condition is applied to the printer.

9 Claims, 36 Drawing Sheets

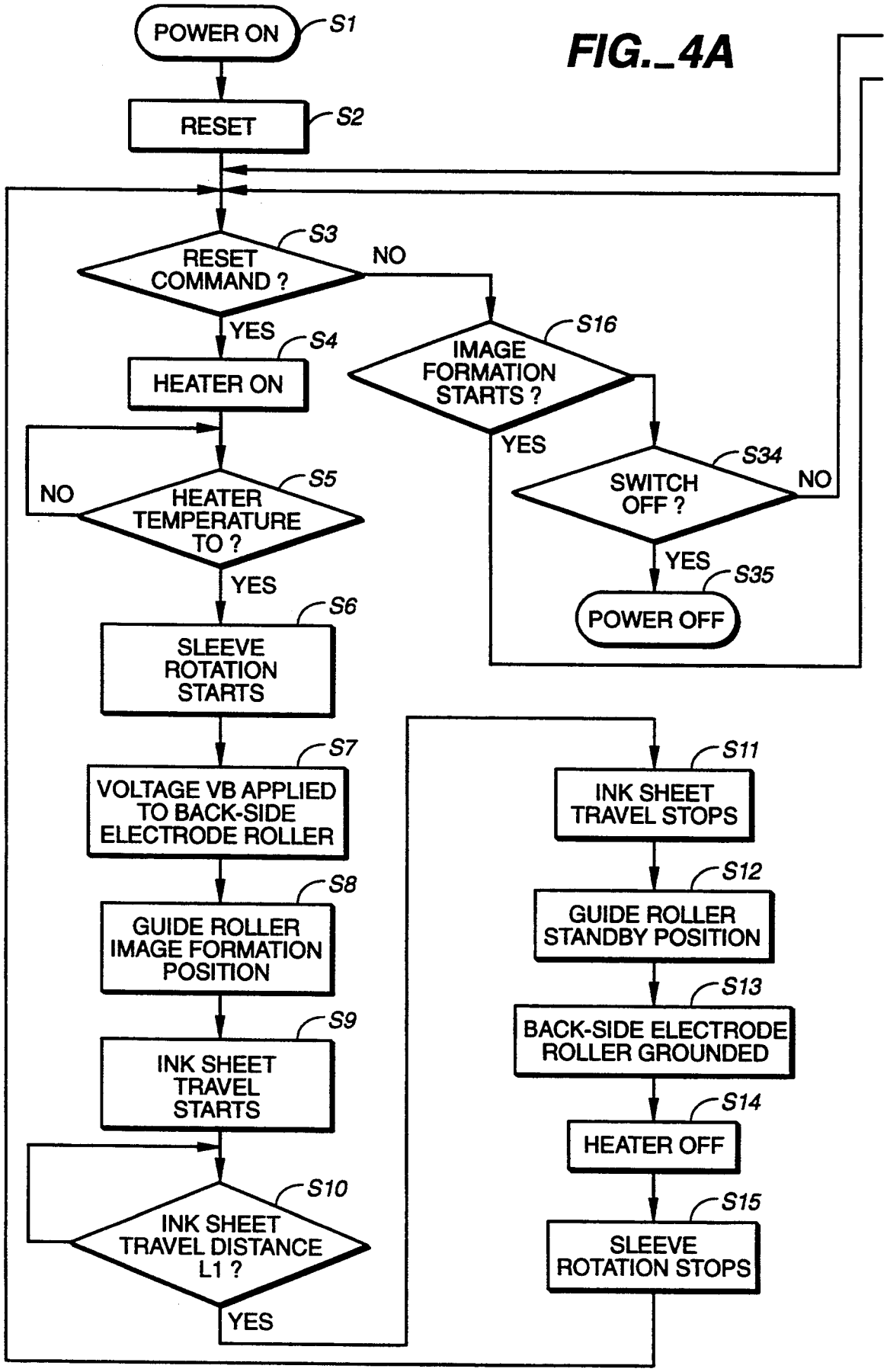
FIG._4A
POWER ON
S1
RESET
S2
RESET COMMAND ?
S3
NO
YES
HEATER ON
S4
HEATER TEMPERATURE TO ?
S5
NO
YES
SLEEVE ROTATION STARTS
S6
VOLTAGE VB APPLIED TO BACK-SIDE ELECTRODE ROLLER
S7
GUIDE ROLLER IMAGE FORMATION POSITION
S8
INK SHEET TRAVEL STARTS
S9
INK SHEET TRAVEL DISTANCE L1 ?
S10
YES
IMAGE FORMATION STARTS ?
S16
YES
SWITCH OFF ?
S34
NO
YES
POWER OFF
S35
INK SHEET TRAVEL STOPS
S11
GUIDE ROLLER STANDBY POSITION
S12
BACK-SIDE ELECTRODE ROLLER GROUNDED
S13
HEATER OFF
S14
SLEEVE ROTATION STOPS
S15

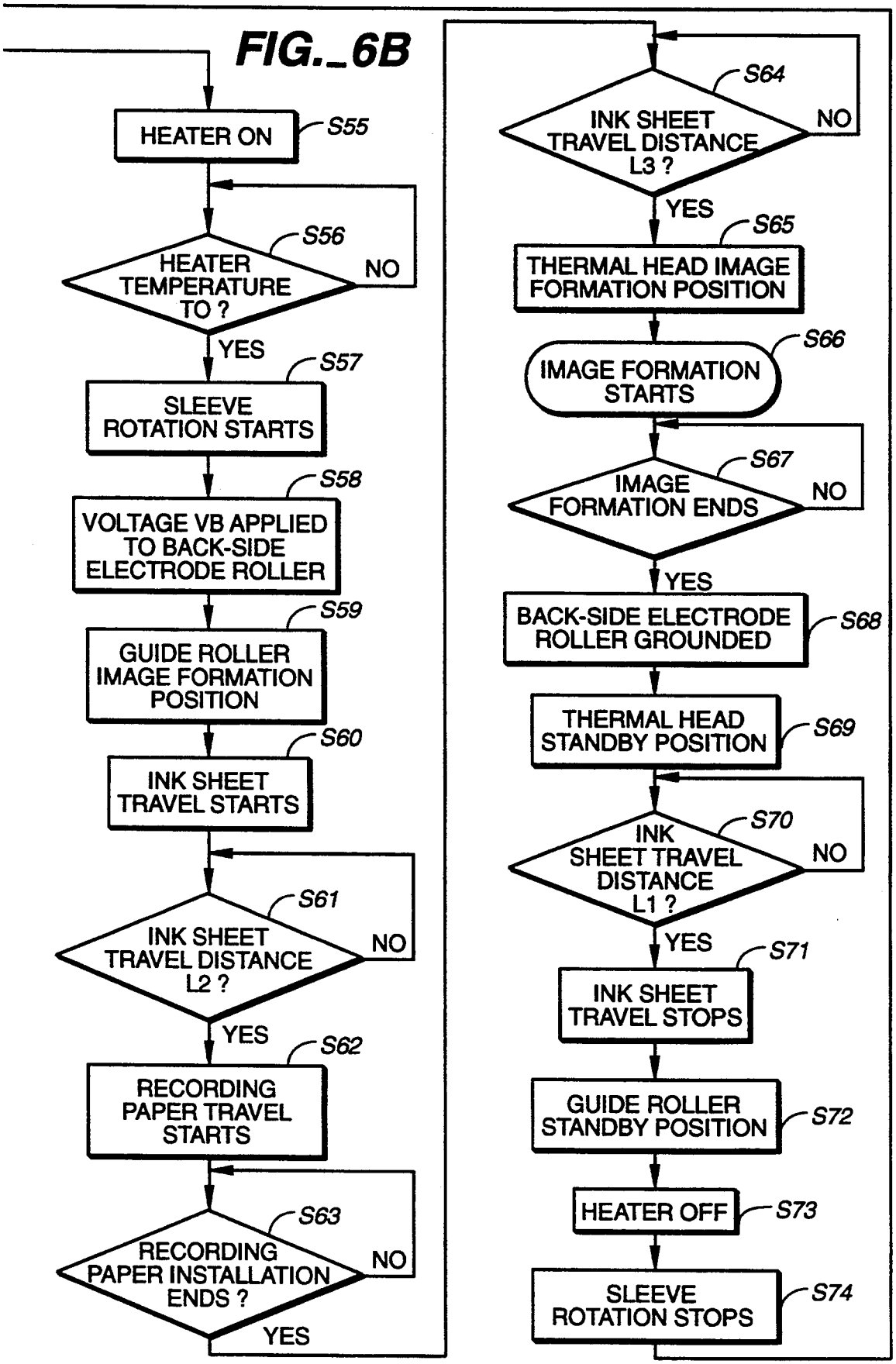
FIG._6B
HEATER ON
S55
HEATER TEMPERATURE TO ?
S56
NO
YES
SLEEVE ROTATION STARTS
S57
VOLTAGE VB APPLIED TO BACK-SIDE ELECTRODE ROLLER
S58
GUIDE ROLLER IMAGE FORMATION POSITION
S59
INK SHEET TRAVEL STARTS
S60
INK SHEET TRAVEL DISTANCE L2 ?
S61
NO
YES
RECORDING PAPER TRAVEL STARTS
S62
RECORDING PAPER INSTALLATION ENDS ?
S63
NO
YES
INK SHEET TRAVEL DISTANCE L3 ?
S64
NO
YES
THERMAL HEAD IMAGE FORMATION POSITION
S65
IMAGE FORMATION STARTS
S66
IMAGE FORMATION ENDS
S67
NO
YES
BACK-SIDE ELECTRODE ROLLER GROUNDED
S68
THERMAL HEAD STANDBY POSITION
S69
INK SHEET TRAVEL DISTANCE L1 ?
S70
NO
YES
INK SHEET TRAVEL STOPS
S71
GUIDE ROLLER STANDBY POSITION
S72
HEATER OFF
S73
SLEEVE ROTATION STOPS
S74

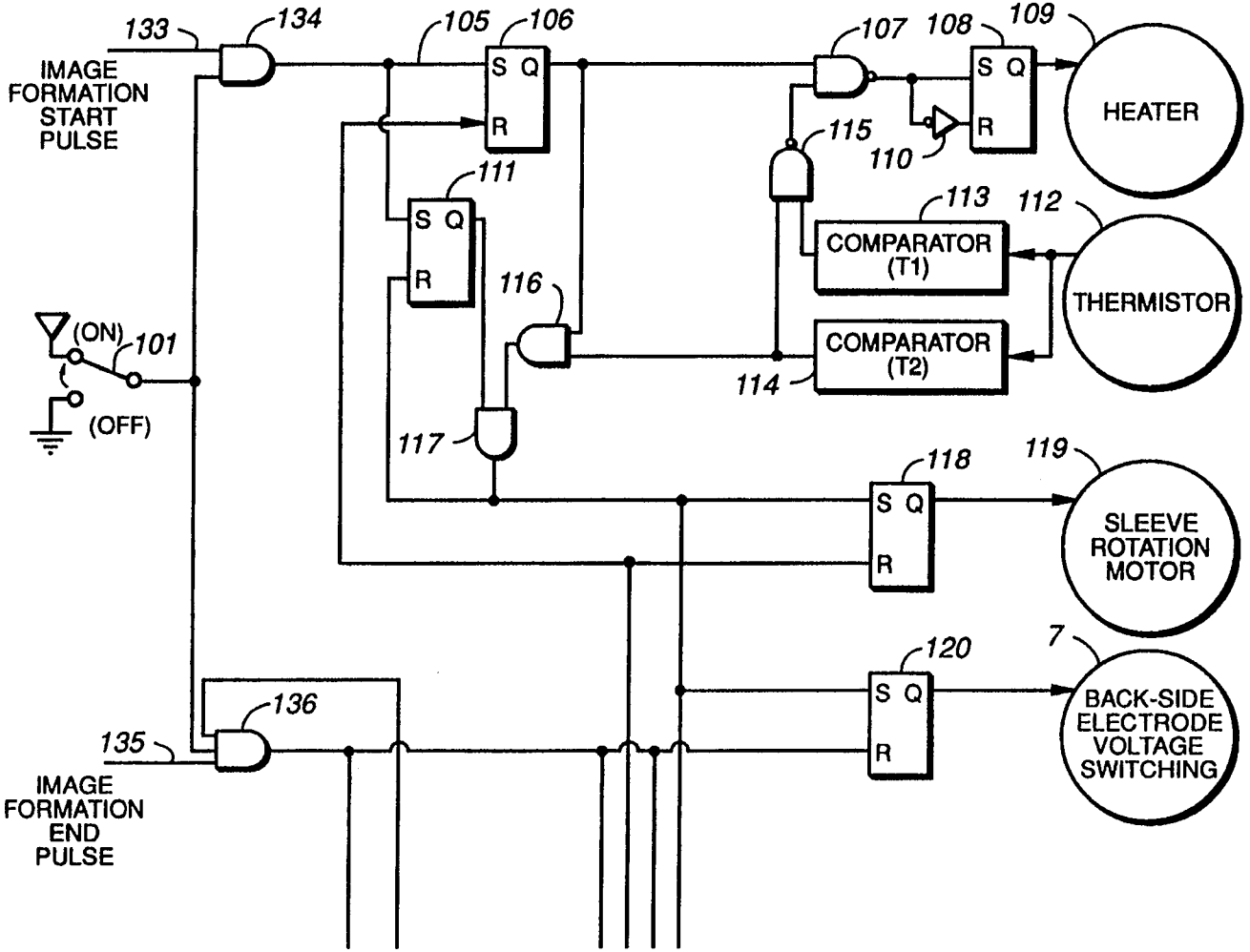
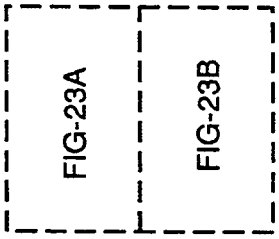
FIG._23
FIG._23A

THERMAL TRANSFER TYPE PRINTER AND METHOD OF REJUVENATING AN INK SHEET EMPLOYED IN THE PRINTER

This is a continuation of application Ser. No. 07/671,802, filed as PCT/JP90/00952 Jul. 26, 1990, and published as WO 91/01889 Feb. 21, 1991, now abandoned.

BACKGROUND OF THE INVENTION

1. Technical Fields

This invention relates generally to thermal-transfer type printers that use ink sheet mechanisms to print with ink on plain paper versus using heat alone on thermally sensitive paper. In particular, it relates to printers that are able to rejuvenate ink sheets using a form of powder ink.

2. Description of the Prior Art

Thermal transfer imaging devices are generally very compact and highly reliable devices, which have been typically used in facsimile (FAX) machines. More widespread use has been prohibited by high operating costs. Such high costs stem mainly from ink sheets that can only be used once. There has been a long felt need to develop an ink sheet that can be used over and over. A number of methods have thus far been devised to regenerate, or rejuvenate, ink sheets within printers for their immediate re-use.

A direct ink layer rejuvenation system has long been proposed for rejuvenating the ink layer on ink sheets with components that have been used for thermal transfer. Such a system melts ink with a heat element and then supplies the melted ink for ink sheet rejuvenation. Rejuvenation methods that use powder ink are described in U.S. Pat. No. 4,467,332. A conductive powder ink has been used as a method that solves certain problems connected with ink sheet rejuvenation technology. For example, the printer described in laid open Japanese patent application number 63-36114 used powder ink.

The print quality available with prior art ink sheet rejuvenation technologies has been of widespread, and much debated concern. Absent from the prior art are techniques to avoid areas on rejuvenated ink sheets that probably contain defects, and there are no solutions to contamination caused by loose powder ink floating around within the ink sheet printing mechanism.

SUMMARY OF THE INVENTION

An objective of the present invention is to provide a printer that effectively and permanently rejuvenates ink sheets, while being highly reliable and having low operating costs.

Briefly, an embodiment of the present invention is an ink sheet printer comprising an ink sheet transport means, an ink sheet rejuvenation means, and a printing means. The transport means is able to move the ink sheet between rollers past the rejuvenation and printing means. The rejuvenation means has a powder ink reserve, a roller that transfers the ink to the ink sheet by electrostatic attraction, and a heat roller that will fix the ink to the ink sheet by melting the powder ink into a stable layer of ink. The printing means has a thermal print head that remelts the ink to print images on paper.

An advantage of the present invention is that, in one embodiment, the rejuvenation means can be positioned in front, or "upstream" of the printing means. In another embodiment, the ink sheet rejuvenation means can be positioned "downstream" of the printing means (relative to the direction of ink sheet movement).

Another advantage of the present invention is that a printer embodiment in which the ink sheet is a continuous-belt is possible.

In order to guarantee good results in rejuvenating an ink sheet, a variety of computer-implemented methods are executed. At least one of these methods causes rejuvenation of the ink sheet when power is turned on, when there is a reset, at the beginning of printing, and at the end of printing or shortly after power is turned off. The methods include operations that transport the ink sheet a predetermined margin distance only or move the ink sheet an appropriate distance such that the ink can be fixed on the ink sheet.

BRIEF DESCRIPTION OF THE DRAWINGS

FIG. 22 and FIGS. 23–23B are schematic diagrams of some control circuits involved in the printing, control, and reset operations for the printer referenced in the method of FIG. 6.

DESCRIPTION OF THE PREFERRED EMBODIMENTS

Figure 1:
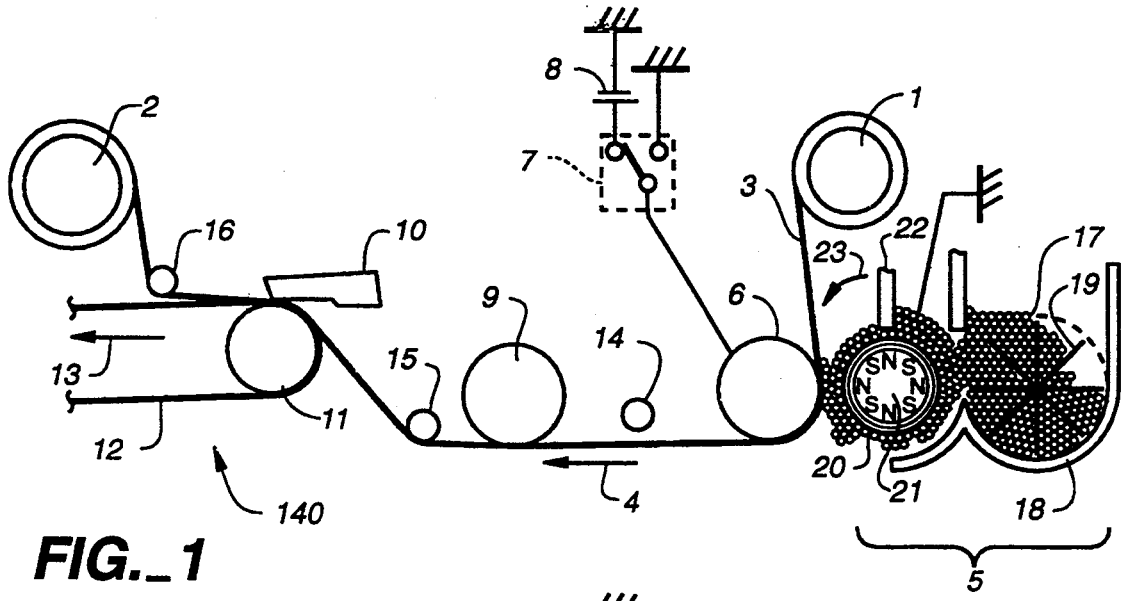
FIG. 1 is a mechanical schematic of a printer embodiment of the present invention with an ink sheet rejuvenation mechanism positioned "upstream" of a printing section.

FIG. 1 is a diagram of a line printer embodiment of the present invention. This embodiment is an exemplary system that uses powder ink to rejuvenate an ink sheet. The line printer has a thermal printing head and the ink sheet is the full-width of paper to be printed on. A feed roller 1 feeds-out an ink sheet 3, which is then received by a take-up roller 2. Initially, ink sheet 3 is wound up on feed roller 1. As it is unwound from feed roller 1, in direction 4, the ink sheet is rejuvenated, and then used for printing. The used ink sheet then is stored on take-up roller 2.

Powder ink feed mechanism 5 deposits powdered ink 17 on ink sheet 3 in amounts that are controlled by a voltage placed on a "back-side" electrode roller 6 from a power supply 8. A switch 7 determines whether or not powder ink is deposited on ink sheet 3. By grounding back-side electrode roller 6, the electrostatic phenomenon responsible for picking up powder ink 17 is blocked. In this example, grounding means having the same electrical potential as the machine casing. It does not necessarily have to be an absolute ground. However, a connection to absolute ground is desirable.

A heat roller 9 fixes the powder ink onto the ink sheet by using heat to melt the ink. Heat roller 9 is electrically heated and positioned to contact the ink sheet 3. Ink 17 permanently clings to ink sheet 3 as a result of heating and melting of the once powder ink.

A thermal printing head 10, ink sheet 3, and some paper 12 are all are pressed against a rubber roller platen 11 during printing. Paper 12 is moved at the same speed as ink sheet 3, in a direction indicated by arrow 13. Just after supply ink is melted onto the ink sheet, thermal printing head 10 prints on the paper by remelting the ink to form a desired printed image. The paper is held flat between platen roller 11 and thermal printing head 10 by applying a constant pressure.

Guide rollers 14, 15, and 16 are used to control ink sheet movements. Guide rollers 14 and 15, in particular, can put heat roller 9 in or out of contact with ink sheet 3. In FIG. 1, as guide rollers 14 and 15 are moved upward, ink sheet 3 and heat roller 9 come into contact. Heat will then be able to fix the powder ink onto the surface of the ink sheet. When guide rollers 14 and 15 move downward, the ink sheet and heat roller no longer make contact with each other. Thus, heat is no longer applied to the ink sheet, reducing thermal deterioration of the ink sheet.

Guide roller 16 controls the separation angle between the ink sheet and paper. It also prevents the thermal printing head and ink sheet from lingering contact with the platen. This technique also improves the longevity of the ink sheet. The ink sheet is saved from unnecessary mechanical tension.

Inking assembly 5 comprises an ink bin 18 which holds a supply of powder ink 17. Powder ink 17 is electrically and magnetically conductive. Inking assembly 5 also uses an agitator 19, which agitates the powder ink 17 in reservoir 18 to prevent lumping, and transfers the powder ink to a conductive sleeve 20. Conductive sleeve 20 is grounded and rotates in the direction indicated by arrow 23 while it deposits powder ink on the surface of the ink sheet. It also establishes an electrical charge (ground) within the powder ink.

Ink supply mechanism 5 also uses a multi-polar magnet 21, located within conductive sleeve 20. Magnet 21 creates a magnetic force that attracts the powder ink which then clings to the surface of conductive sleeve 20. Ink supply mechanism 5 also employs a scraper 22, which regulates the amount of powder ink that is deposited on conductive sleeve 20. The gap between back-side electrode roller 6 and conductive sleeve 20 is tightly controlled by runners or spacers.

The main component of the powder ink is a material such as a low melting point wax. A material that contains an appropriate amount of strong magnetic material, such as the conductive material combination of carbon black and magnetites can be added to obtain the desired magnetic properties. In addition, any powder inks that show strong magnetic properties, melt by heat, demonstrate conductivity, and can be transported by the conductive sleeve, can be used.

For the granular diameter, a diameter should be selected based on the minimum amount of powder ink that satisfies the required concentration or density for the desired images, and so that ink material is deposited on the surface of the ink sheet in one even layer. A grain size of 10 micrometers is a standard value. However, grain sizes within a range of 5 micrometers to 20 micrometers are acceptable.

Next, a simple explanation will be given of the ink sheet rejuvenation method used in a printer according to the present invention. Ink sheet 3 is made of a base film that has electrically insulating properties. The ink has electrically conductive properties. Ink sheet 3 does not have to be an ink sheet base that has had ink applied to it in advance. An ink sheet base that has had no ink applied to it in advance is acceptable when using the present invention. This is because an ink layer can be formed on this base while printing is taking place.

An electrode may be formed on the back surface of the ink sheet. If such an electrode is used, the amount of voltage $V_b$ that must be applied to back-side electrode roller 6 when the ink sheet is rejuvenated can be reduced. The back-surface electrode does not have to be electrically connected throughout the entire back surface of the ink sheet. Island-shaped electrode groups that are electrically isolated are acceptable. Electrically isolated electrodes are desirable because they prevent large current flow when there is an electrical leak.

When the ink sheet is rejuvenated, voltage $V_b$ is applied to back-side electrode roller 6, while conductive sleeve 20 remains grounded. Enough powder ink will form a thick enough layer to bridge most or all of the distance between conductive sleeve 20 and back-side electrode roller 6 to make electrical contact. A charge is placed on the outside tips of the powder ink layer that is equal to that of conductive sleeve 20. The charged tips of powder ink are then electrically attracted to ink sheet 3 by an opposite polarity charge which is applied to the back side of the ink sheet by back-side electrode roller 6. An electrostatic force then causes ink to be attracted to, transfer to, and cling to, the ink sheet.

Because the link of powder ink carrying the electric charge from the conductive sleeve is made only at the tips of the ink layer, no force exists to attract all of the ink on conductive sleeve 20 to ink sheet 3. This limits how much ink can be deposited on ink sheet 3.

The electrostatic attraction is such that ink will only be deposited on ink sheet 3 areas where no ink already exists. Therefore, only the used areas of ink sheet 3 will be resupplied with a consistent amount of ink.

At this point, the ink is unstable and only held on the ink sheet by an electrostatic charge that can bleed off. Eventually the charge will dissipate and the ink will flake off. Preferably, the ink should be permanently fused, adhered, or fixed, to the ink sheet. Melting the powder ink on the ink sheet makes the ink permanent and stable.

The finished ink layer surface does not have to be smooth and flat after the above ink rejuvenation. Since pressure will be applied to the layer in later printing steps, a granular or patchy ink layer will have the worst spots flattened down. In some cases, a patchiness in the ink layer can actually allow the ink to spread a little better, and improve print quality.

Feed roller 1, take-up roller 2, and ink sheet 3 are preferably housed in a single-piece removable ink sheet cartridge (not shown). Preferably, the take-up feed sections of the cartridge are symmetrical. Once a used ink sheet is completely wound up onto a take-up roller, the cartridge is removed, flipped over, and reinstalled in the opposite direction. Now the take-up section becomes the feed section.

The large area of ink sheet 3 can easily become loose. Therefore, tension on ink sheet 3 is maintained by using a roller section equipped with a tensioning assembly, and by using a lock that engages whenever the cartridge, housing ink sheet 3, is removed from the printer.

The body of the printer is generally partitioned into top and bottom sections. The top section is such that parts of the top and bottom sections will join to form a fulcrum and beam. The top section can then be moved about the fulcrum to provide access to the ink sheet cartridge. The top section typically comprises an upper casing and a movable upper frame.

The movable upper frame houses back-side electrode roller 6, guide roller 14, heat roller 9, guide roller 15, thermal printing head 10, and guide roller 16. The design is such that the ink sheet cartridge can be easily installed and dropped into place. The ink sheet cartridge and upper frame are aligned with each other to ease installation. When the bottom section is lowered, the upper frame moves farther down than the upper casing to form an opening, so that ink sheet 3 can be extracted. The placement of the components is as shown of FIG. 1.

A constant rotational torque is applied to feed roller 1 so that an appropriate amount of tension is maintained on ink sheet 3. This prevents undesirable wrinkling and sagging of ink sheet 3. The principle rotational force applied to ink sheet 3 comes from platen roller 11. Secondarily, take-up roller 2 will pull ink sheet 3 through the printer, especially when there is no printing, because platen roller 11 will not have sufficient contact with ink sheet 3 to pull it through.

The printer is put into a standby mode whenever the power is turned off. In standby mode, the electrical potential of the backside electrode roller is allowed to float. Electrode roller 6 stops rotating and assumes the same electrical potential as the main casing. Guide rollers 14 and 15 are put in their downward positions, which separates heat roller 9 from ink sheet 3. Thermal printing head 10 is pulled away from ink sheet 3.

Figure 2A:
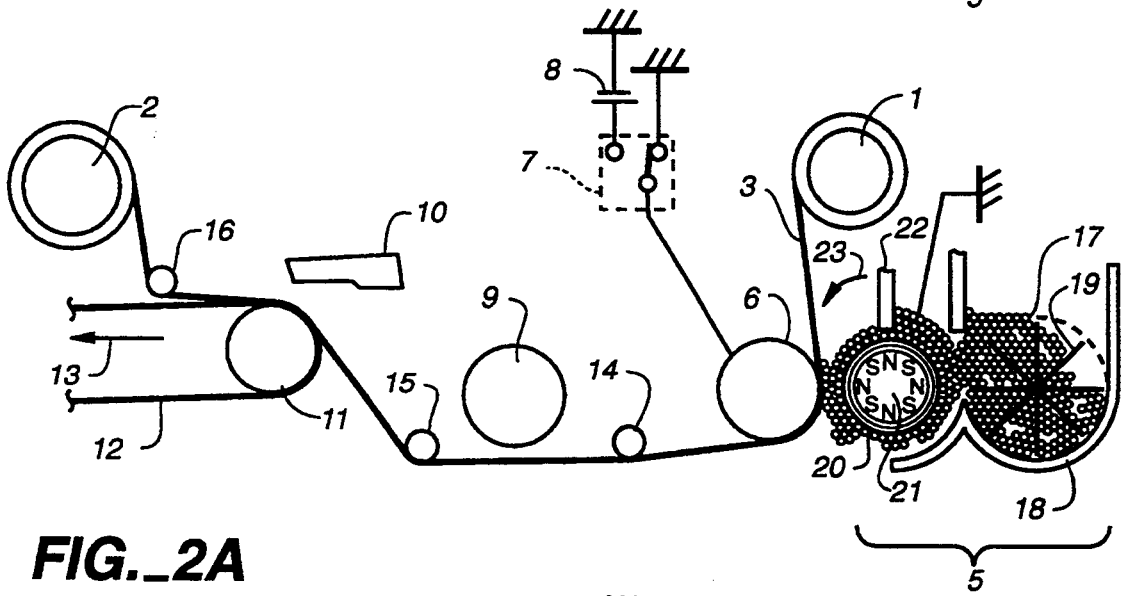
FIGs. 2A, 2B, 2C and 2D show the printer of FIG. 1 positioned in various operating modes.

The printer goes into standby mode whenever it has to wait for a start printing command. See, FIG. 2A. As such, the back-side electrode roller is grounded, the conductive sleeve is stopped, guide rollers 14 and 15 have lowered, heat roller 9 and ink sheet 3 are not in contact with each other, and thermal printing head 10 is not in contact with the ink sheet either.

The setup to enable printing is just the opposite of the above standby position. Guide rollers 14 and 15 are moved up, bringing heat roller 9 into contact with ink sheet 3, thermal printing head 10 is pressed against platen roller 11 which pinches any paper 12 and ink sheet 3 in between.

Figure 2B:
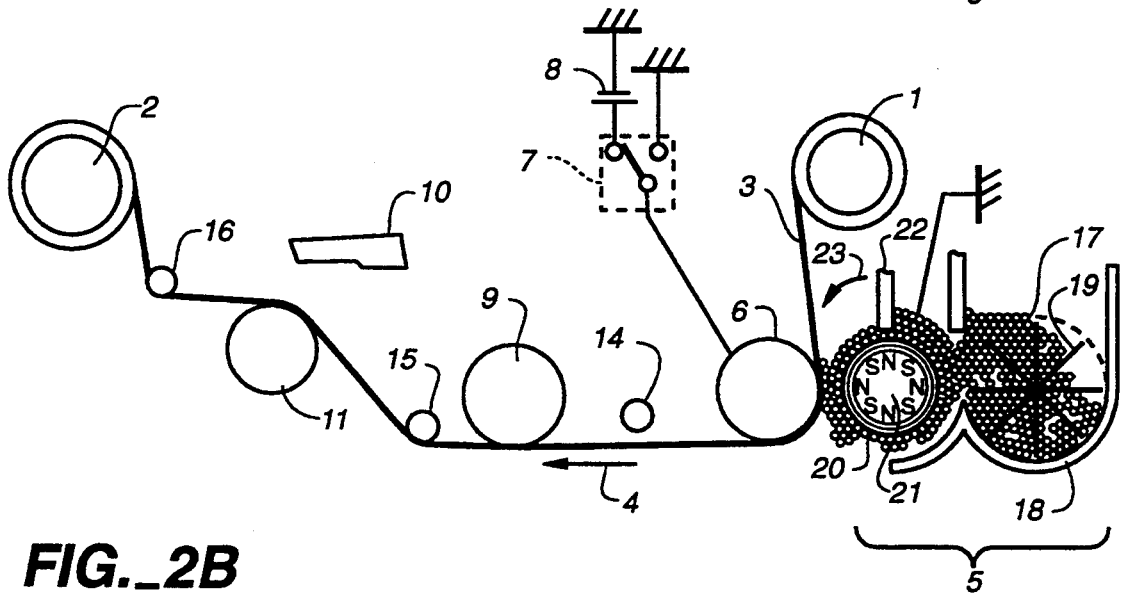

FIG. 2B shows the setup conditions necessary for ink sheet 3 to be rejuvenated. A voltage "$V_b$" is applied to back-side electrode roller 6. Guide rollers 14 and 15 are moved to their printing positions, but thermal printing head 10 is pulled back into its standby position.

Figure 2C:
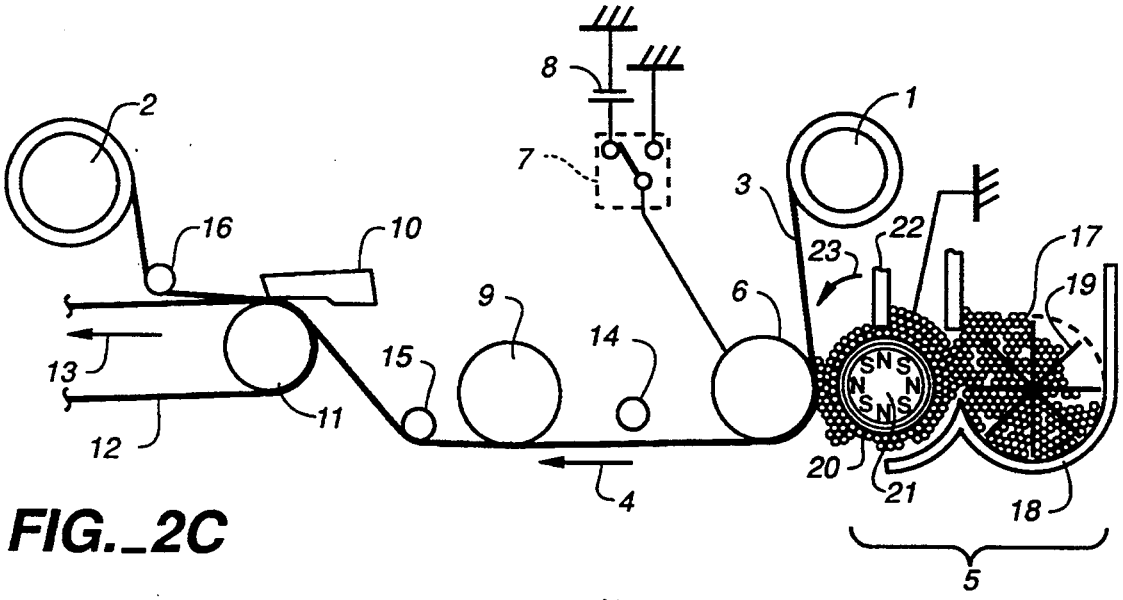

FIG. 2C shows the setup conditions for a concurrent printing and ink sheet rejuvenation mode. In this mode, voltage $V_b$ is applied to back-side electrode roller 6, and guide rollers 14 and 15 and thermal printing head 10 are all moved into their respective printing positions.

Figure 2D:
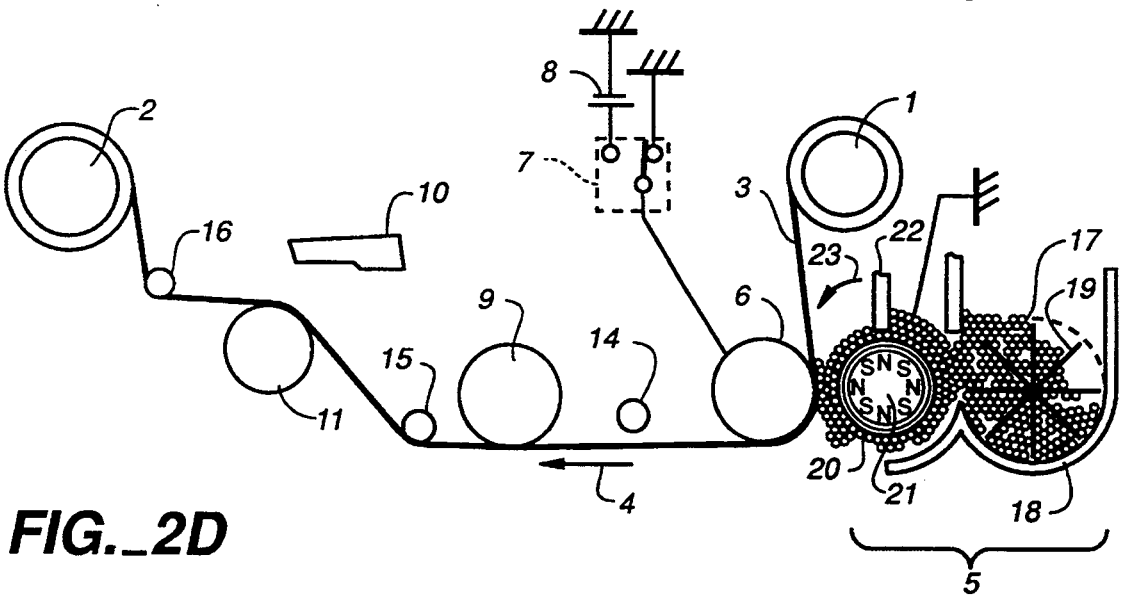

FIG. 2D shows the setup conditions for only heat fixing the powder ink 17 to ink sheet 3. Here, back-side electrode roller 6 is grounded, guide rollers 14 and 15 are in their printing positions, and thermal printing head 10 is in its standby position.

Figure 3:
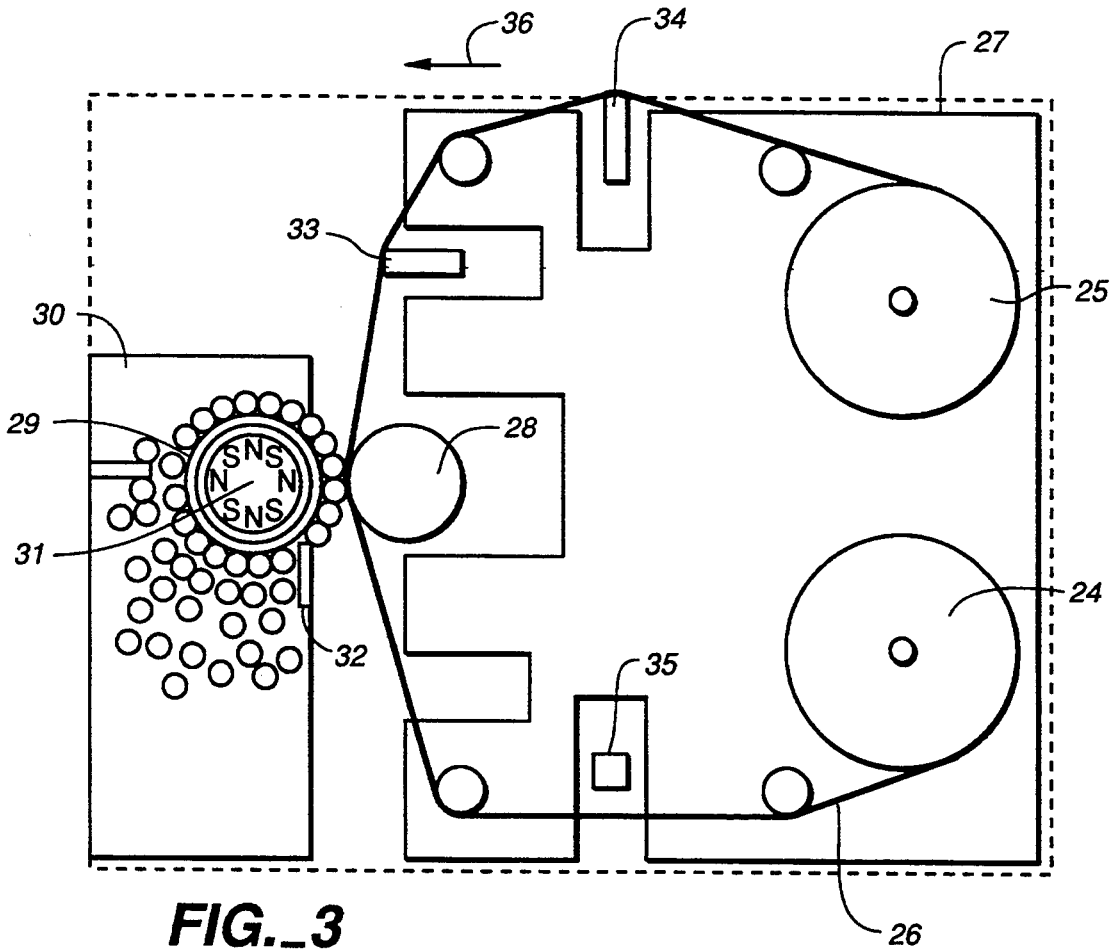
FIG. 3 is a schematic of another printer embodiment of the present invention with an ink sheet rejuvenation mechanism again positioned upstream of the printing section.

Another embodiment of the present invention is that of a serial printer. FIG. 3 shows a thermal printing head carriage section used in such a serial printer. A cartridge 27 is used having an ink ribbon 26, a feed roller 24, and a take-up roller 25. Cartridge 27 presses against a thermal printing head carriage section 34. Ink ribbon cartridge 27 can be flipped over such that rollers 24 and 25 reverse their respective functions as feed and take-up rollers, in which case ink ribbon 26 reverses its direction within cartridge 27.

During printing, ink ribbon 26 will be partially drawn out of cartridge 27 by back-side electrode roller 28 so that it just makes contact with powder ink 30. Ink 30 is both conductive and strongly magnetic, and will adhere to and be transferred by conductive sleeve 29. Inside conductive sleeve 29 is a multi-pole magnet 31. The amount of powder ink 30 transferred by conductive sleeve 29 is regulated by a scraper 32 that has an adjustable gap.

Rejuvenation of ink ribbon 26 starts by applying an electrical voltage between back-side electrode roller 28 and conductive sleeve 29. This puts a charge on the powder ink and causes ink ribbon 26 to electrostatically attract the ink. Any powder ink that transfers to ink ribbon 26 will be melted a short distance away by a heater 33. Then the ink becomes permanently fixed on ink ribbon 26. Heater 33 heats a strip that is wider than thermal printing head 34. If thin-film fabricated heating elements are used in heater 33, it can be made as small as the thermal printing head. After a point on ink ribbon 26 passes heater 33, that point moves under thermal printing head 34, where the actual printing of an image in ink onto paper takes place.

A detector 35 can optically sense when the end of the ink ribbon is reached. Reflectors on each end of ink ribbon 26 are preferably used to help signal the end of ink ribbon tape. Cartridge 27 should then be flipped over when the end has been reached. The reflectors can be fabricated on the tape ends by depositing an aluminum layer. The carriage and cartridge 27 move in direction 36 while printing. Ink ribbon 26 feeds out from feed roller 24 such that ink ribbon 26 is still against the paper as print head 34 scans across. Rejuvenation and printing can, therefore, be accomplished in one-step at identical speeds.

In a standby mode similar to the above, thermal printing head 34, heater 33, and back-side electrode roller 28 are moved away from the ink ribbon into their "standby positions" so that they will not interfere with ink ribbon 26 (even when cassette 27 is being installed). Thermal printing head 34 will not cause ink ribbon 26 to contact the paper. Heater 33 and back-side electrode 28 are also not in contact with ink ribbon 26.

In the setup necessary for printing, thermal printing head 34, heater 33, and back-side electrode 28 are all moved to their "printing positions", which are shown in FIG. 3. For ink rejuvenation, a bias voltage is placed on back-side electrode 28 and heater 33 is turned-on. In this mode, ink ribbon 26 will be rejuvenated while thermal printing head 34 is printing.

When ink is to be rejuvenated without printing, only thermal printing head 34 is pulled back into its standby position. Heater 33 and back-side electrode 28 remain in their printing positions. A voltage is applied to back-side electrode 28 at the same time ink ribbon 26 is pulled from roller 24 toward roller 25.

The printer designs of FIGS. 1 and 3 have the ink sheet rejuvenation mechanism placed such that ink sheets 3 and 26 are rejuvenated before either reaches its respective thermal printing head area. As such, the take-up rollers have used ink sheets or ink ribbons wound on them and rejuvenation is needed before their next use. An advantage of this configuration is that only the lengths of ink sheet or ribbon actually required for printing will be rejuvenated. As a result, this reduces ink waste to a minimum. Since ink sheets and ribbons can be quite long, rejuvenating only the length of ink sheet actually required has a large impact.

Another advantage is that during actual use, it is normal for ink sheet rejuvenation to be done in short bursts rather than continuously. However, troublesome ink sheet defects at any joint between successive rejuvenations are likely. In the above configurations, the relative position of the thermal printing head to possible joint defects can be easily determined. Preventive measures can be taken, such as feeding such joints past the thermal printing head before printing. Doing so helps to maintain high quality print outputs.

The devices of FIGS. 1 and 3 each have a heater that heat fixes the powder ink by melting just after the ink is deposited by the inking assembly. After deposition, but before fixing by heat, the powder ink has only a weak electrostatic adhesion force that has no longterm stability. If left unmelted, the ink will eventually scatter inside the printer and contaminate the internal working parts bad enough to adversely effect printing quality. Such problems can be minimized if the heat roller is located adjacent to the inking assembly. Ink can be fixed just a short distance after being deposited. Keeping the distance short proportionally reduces the amount of ink that can be scattered.

The operation of the above printers is described in detail, beginning with a discussion related to FIG. 4 below. While the description is directed mainly to the printer of FIG. 1, it can be applied equally as well to the operation of the printer of FIG. 3.

Figures 4, 4B:
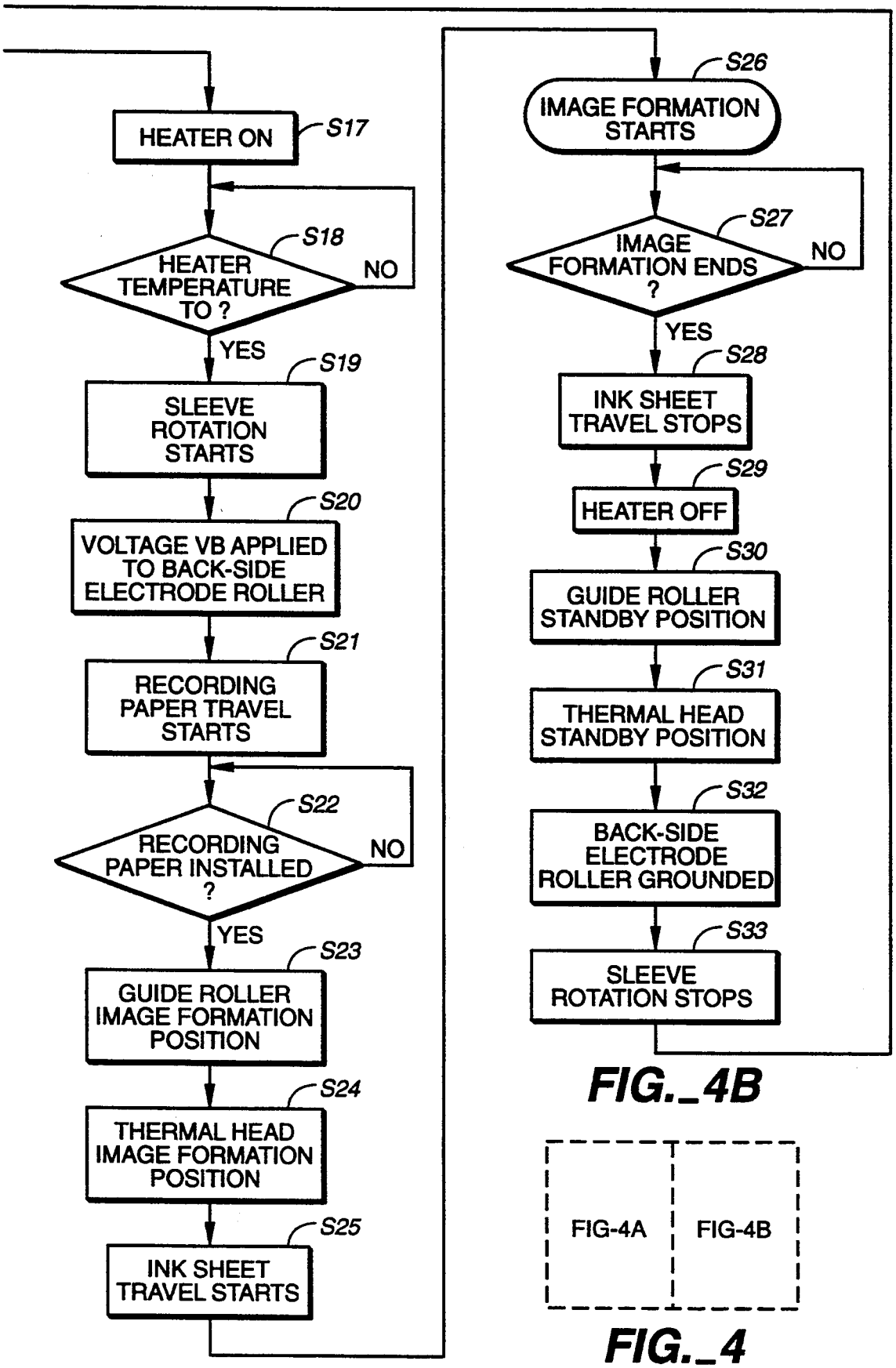
FIGS. 4–4B are a flowchart of an exemplary method for controlling a part of the printer of FIG. 1.

FIG. 4 is an exemplary method of controlling the above printers and is presented here in the form of a flowchart. Referring now to the flowchart, when power is turned on, the printer is reset (steps S1 to S3). Then, a sequence of steps process the ink sheet, as follows:

1. Heater turn-on. Heater on standby (S3 and S4) until it reaches a specified temperature $T_O$.
2. Conductive sleeve starts rotating (step S6).
3. Apply voltage $V_b$ to back-side electrode roller (step S7).
4. Guide rollers 14 and 15 are moved to their respective printing positions (step S8).
5. Ink sheet moves (step S9).
6. Ink sheet travels only a distance L1, from back-side electrode roller 6 to heat roller 9, and stops (step S10).
7. Guide rollers 14 and 15 are moved to their standby positions (step S13).
8. Back-side electrode roller is grounded (step 13).
9. Heater is turned off (step S14).
10. Conductive sleeve rotation stops (step S15). The unit then is put in standby mode.

The reset command (step S2) is generated for a variety of reasons, not just after the power is turned on. For example, the printer will execute an emergency stop when error conditions are detected from inputs from the various sensors for paper movement, excessive current and motor overload detection, ink sheet movement, and device door-open. When the cause of the error has finally been corrected, a reset command will be generated. The remaining sequences in FIG. 4 (steps S4 to S15) will then follow, after which the device will enter standby mode.

Also, the accumulated time of consecutive standby conditions is collected. When the aggregate time in standby exceeds a predetermined amount, another reset command (unconditionally jumping to step S2) will be generated. A relatively short time is all that is needed for the electrostatic charge within the powder ink to dissipate. For a continuous standby of half a day to a full day, there will not be much scattering of powder ink that was left unfixed by heating. However, if the standby is longer, scattering of powder ink and contamination can be a problem.

Figure 5:
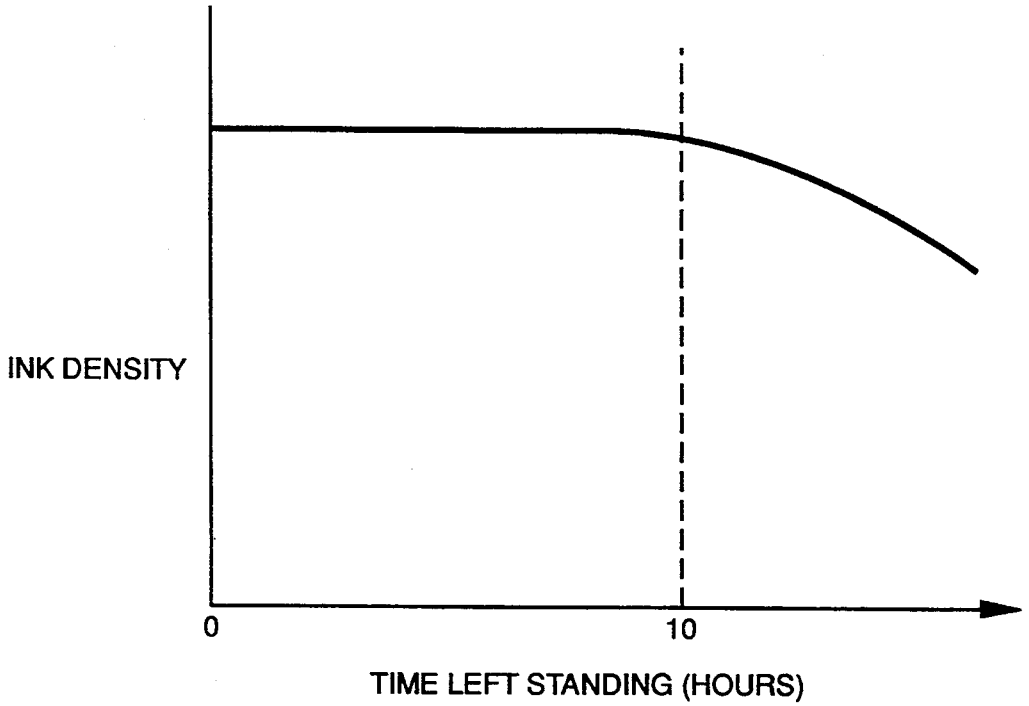
FIG. 5 is a graph of the relationship between the time in hours that unmelted powder ink stays on an ink sheet after deposition and the density of printing.

FIG. 5 shows a plot of the ink density, over time, after a rejuvenated portion of the ink sheet has first been in standby (left unfixed) and then used for printing. The vertical axis in the diagram represents printing concentration (how dark the printed image is), while the horizontal axis represents time in hours that the ink was left unfixed. According to this graph, the longer the time, the less the ink density. Because there is a considerable reduction in printing concentration when the ink is left unfixed over 10 hours, it is best to set the upper time limit to 8 hours.

Returning to FIG. 4, steps S16 to S26 are as follows:

1. Heater turns on. Heater is in standby (steps S17 to S18) until the temperature reaches $T_O$.
2. Conductive sleeve starts rotating (step S19).
3. Voltage $V_b$ applied to back-side electrode roller (step S20).
4. Paper feed starts. Paper feeding continues until it reaches a predetermined position (step S22).
5. Guide rollers 14 and 15 move to printing positions (step S23).
6. Thermal printing head travels to its printing position (step S24).
7. Ink sheet starts to move (step S25). Then printing begins (step S26).

After printing is completed, steps S27 to S32 are as follows:

1. The ink sheet is stopped (step S28).
2. Heater is turned off (step S29).
3. Guide rollers are moved to their respective standby positions (step S30).
4. Thermal printing head moves to its standby position (step S31).
5. Back-side electrode roller is grounded (step S32).
6. The conductive sleeve rotator is stopped (step S33). Afterwards, the printer returns to standby mode.

In FIG. 4, after the power is turned on, or each of the various error conditions is restored, or the standby time continues beyond the specified time, the ink sheet is moved distance L1 while it is being rejuvenated. Distance L1 is the distance between back-side electrode roller 6 and heat roller 9. This results in a portion of ink sheet moving to thermal printing head 10 that can be relied on to be rejuvenated. Image quality stays high.

The contamination of the inside of the printer due to scattered powder ink in the above embodiment(s) will be infrequent because the area of the ink sheet where powder ink has not yet been permanently fixed will be limited to a small area between back-side electrode roller 6 and heat roller 9.

As for the amount of powder ink used, the area of the ink sheet rejuvenated is only that area between back-side electrode roller 6 and thermal printing head 10. The other areas of the ink sheet have not been rejuvenated. As a result, when the ink sheet has reached its life expectancy or when it has to be changed because of sudden problems, that portion of the ink sheet which is wasted, as such, because it was rejuvenated but can no longer be used for printing, is extremely small. This also reduces the wasteful consumption of powder ink to a minimum.

Experience shows a maximum of 50 grams of powder ink will be wasted for ink sheets that are 300 meters by 25 centimeters in size. In this example, it is assumed the entire length of the ink sheet has been used and rejuvenated and printing conditions have been average.

Figures 6, 6A:
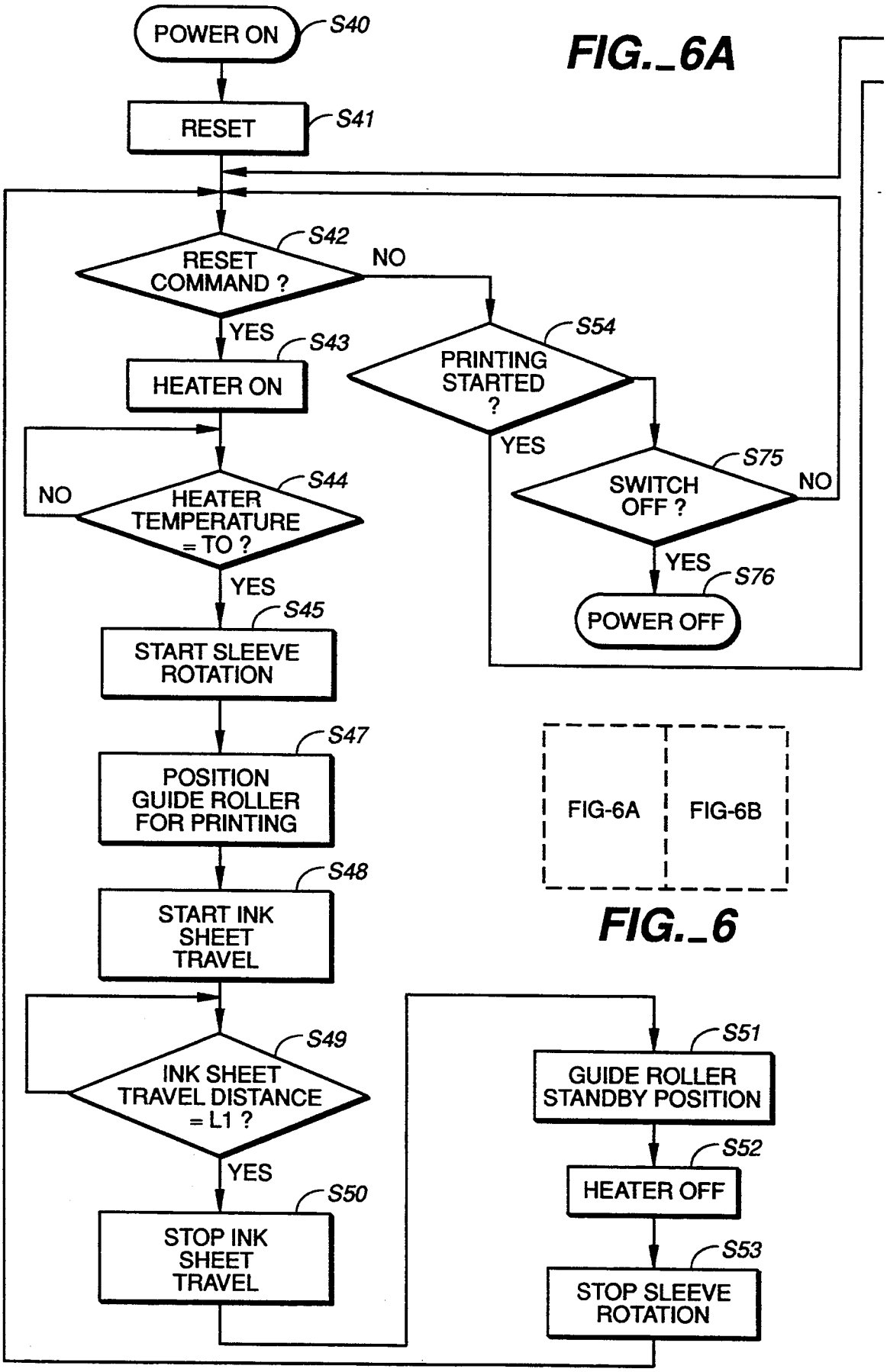
FIGS. 6–B are a flow chart of another exemplary method for controlling a part of the printer of FIG. 1.

FIG. 6 is another method presented in flowchart form. When power is turned on, the printer is reset (steps S40 and S41). As above, a reset results after an error condition has been corrected or when the aggregate standby time gets too high. When a reset results, the following steps then occur:

1. Heater turns on and is in standby mode until the temperature reaches $T_O$, the specified value (steps S43 and S44).
2. The back-side electrode roller is grounded (step S45). As such, no ink is supplied.
3. The conductive sleeve starts to rotate (step S46).
4. Guide rollers 14 and 15 move to their printing positions (step S47).
5. The ink sheet begins to move (step S48).
6. The ink sheet travels distance L1, from back-side electrode roller 6 to heat roller 9, and stops (steps S49 and S50).
7. Guide roller 14 and 15 are moved to their standby positions (step S51).
8. Heater is turned off (step S52).
9. The conductive sleeve rotation is stopped (step S53) and the unit enters standby mode.

When the above steps are executed, any unmelted powder ink laying on the ink sheet between the back-side electrode roller and heat roller 9 will be heat fixed as it passes by the heater. No new ink will be deposited, and so there will be an area of the ink sheet that should later be avoided. As a result, all of the powder ink that had only been clinging to the ink sheet electrostatically will be permanently fixed via melting. This procedure greatly eliminates any in-progress rejuvenation that had been interrupted from becoming the source of ink contamination.

A description of the printing operations of each section now follows. After a printing command is input, printing starts with the following (steps S54 to S66):

1. Heater turns on. The heater is on standby until it reaches specified temperature $T_O$ (steps S55 and S56).
2. Conductive sleeve rotation begins (step S57).
3. Voltage $V_b$ is applied to back-side electrode roller 6 (step S58).
4. Guide rollers 14 and 15 move into their printing positions (step S59).
5. The ink sheet starts moving (step 60).
6. The ink sheet is moved the sum of distances L2 and L3, from back-side electrode roller 6 to thermal printing head 10 (steps S61 and S64).
7. The paper starts moving to its pre-assigned position (steps S62 and S63).
8. Thermal printing head moves to its printing position (step S65).

Before paper is loaded, the ink sheet should only move distance L2. After the paper is loaded, the ink sheet can be moved the additional distance L3, in unison with the paper. The distances L2 and L3 are fixed in advance, such that sum of distances L2 and L3 is exactly equal to the distance the ink sheet must travel between back-side electrode roller 6 and thermal printing head 10. Paper stops at print head 10 when first loaded. Printing will begin with step S66 after finishing with the above sequence.

The above steps take into account that a portion of the ink sheet located between back-side electrode roller 6 and thermal printing head 10 may not have been completely rejuvenated. This piece will be fed beyond thermal printing head 10. Thus, that portion of the ink sheet will not be used for printing, which allows for consistent high quality images, even after startup.

After printing, control can pass either to the steps of FIG. 4 (steps S28 to S33) or the steps of FIG. 6 (steps S68 to S74). Referring now to FIG. 6

1. Back-side electrode roller is grounded (step S68).
2. Thermal printing head is moved to its standby position (step 69).
3. The ink sheet motive power switches to use the take-up roller.
4. The ink sheet is moved a distance L1, from back-side electrode roller 6 to heat roller 9, then stops (steps S70 and S71).
5. Guide rollers are moved into their standby positions (steps S72).
6. Heater is turned off (step 73).
7. The conductive sleeve rotation is stopped (step S74). Then, the unit enters standby mode.

As a result of this method, the powder ink on the ink sheet that has not yet been permanently fixed will be permanently fixed before entering a standby mode. As a result, there will be no scattering of powder ink during the subsequent standby mode.

Moreover, the steps used after completion of printing in FIG. 6 (steps S68 to S74) can be substituted for the steps in FIG. 4 (steps S28 to S33).

Figures 7, 7A:
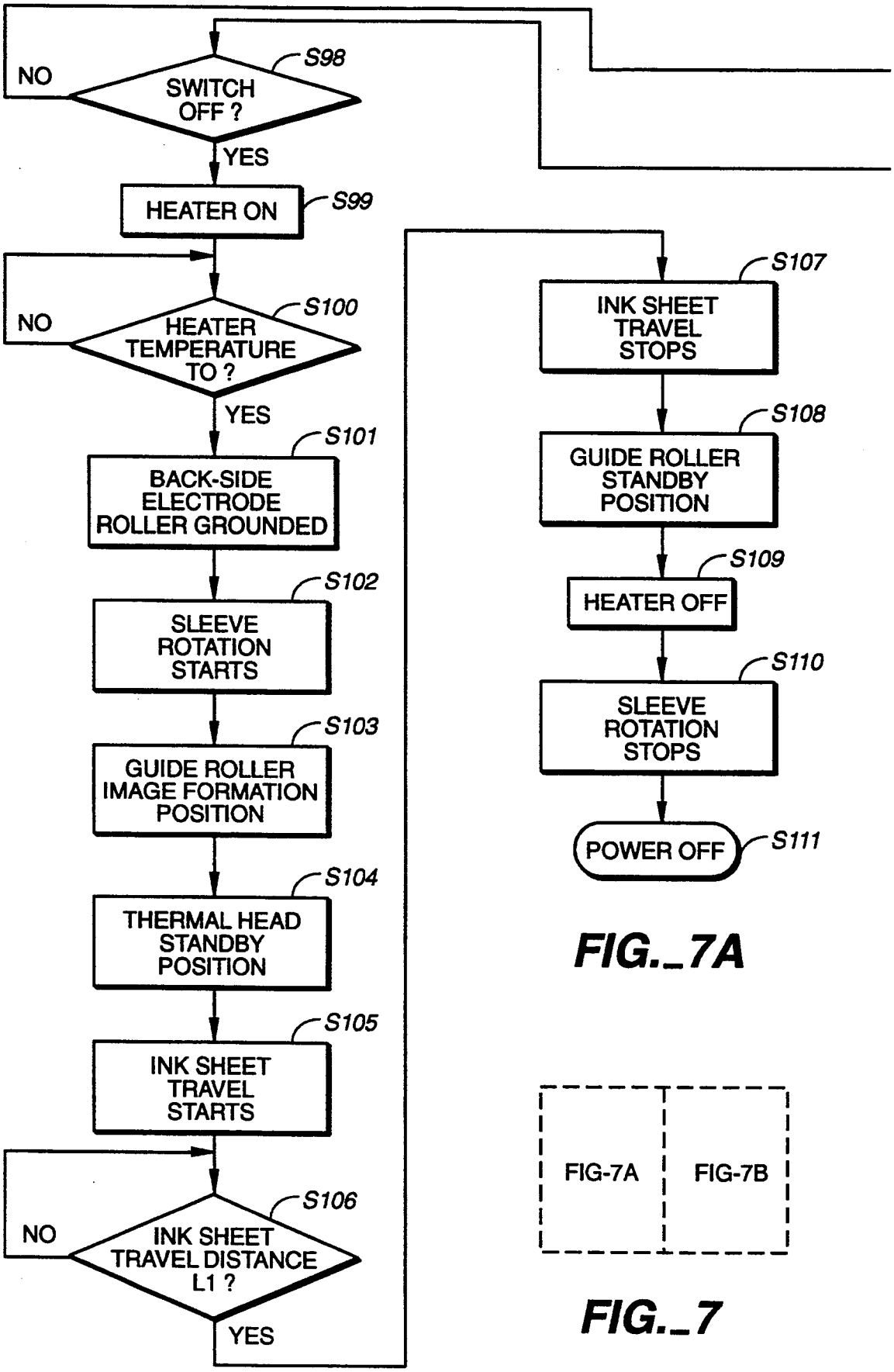
FIGS. 7–7B are a flow chart of yet another exemplary method for controlling a part of the printer of FIG. 1.
Figure 7B:
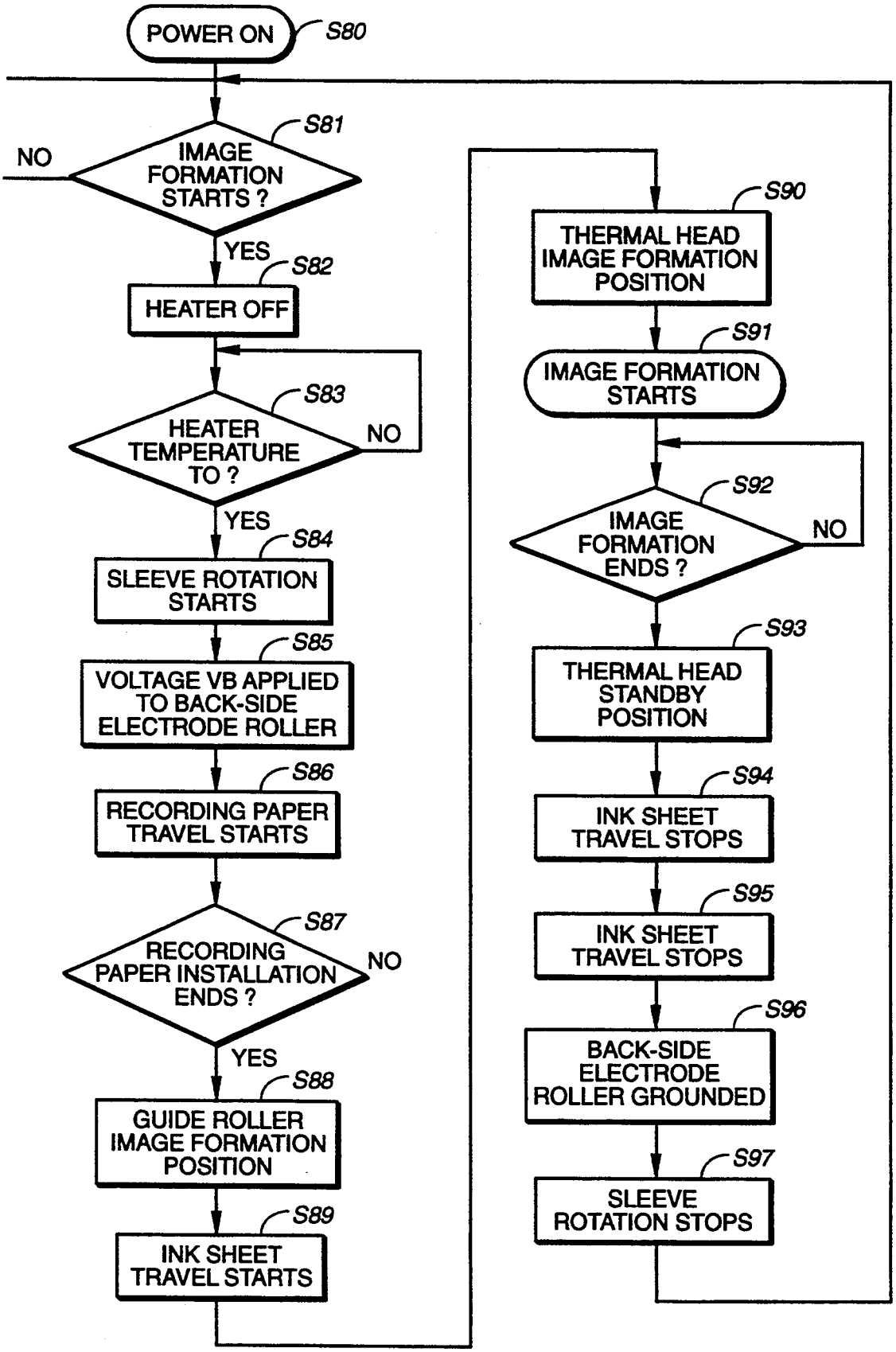

FIG. 7 shows still another method used for printing and rejuvenation. With this sequence, the steps after a printing command is received and before the end of printing (steps S81 to S97) are the same as steps S16 to S33 of FIG. 4. The difference in this method is in the steps taking place after the power switch is turned off. When a power switch is turned off, the following steps are executed:

1. Heater turned on. The heater remains in standby position until the temperature reaches $T_O$ (steps S99 and S100).
2. The back-side electrode roller is grounded (step S101).
3. Conductive sleeve begins rotating (step 102).
4. Guide rollers 14 and 15 move to their respective printing positions (step S103).
5. The thermal printing head is moved to its standby position (step S104).
6. The ink sheet travels distance L1, the distance between back-side electrode roller 6 and heat roller 9, and then stops (steps S105, S106 and S107).
7. Guide roller 14 and 15 are moved to their standby positions (step S108).
8. Heater is turned off (step 109).
9. Conductive sleeve rotation is stopped (step S110).

After this method is executed, the main power supply within the device will be turned off (step S111). By executing this sequence before the power is finally turned off, the unmelted powder ink on the surface of the ink sheet will be fixed by melting, thus eliminating a cause of ink contamination within the device. Either the method of FIG. 4 or that of FIG. 6 may be used as the source of the power off sequence (steps S98 to S111).

Figure 8:
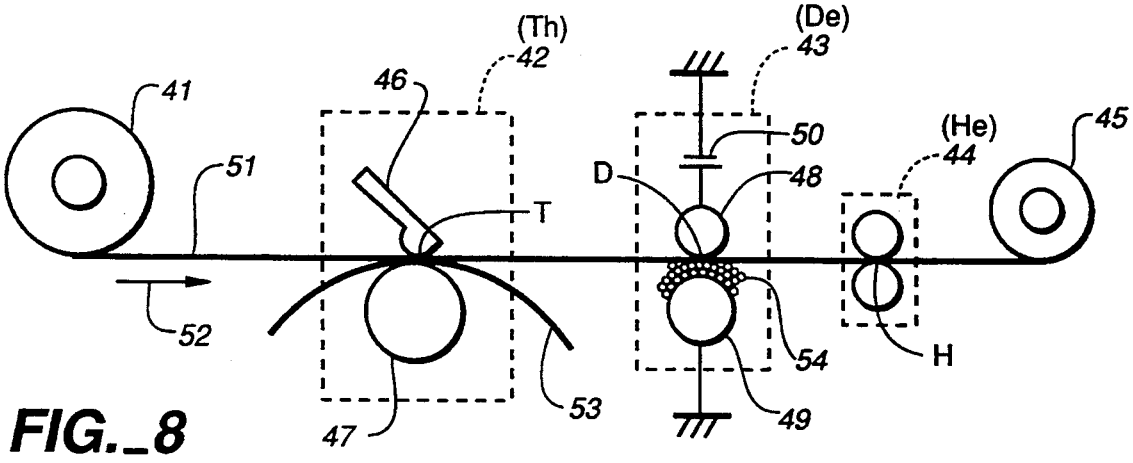
FIG. 8 is a drawing of a printer embodiment in which the ink sheet rejuvenation mechanism is positioned downstream of the printing section.

FIG. 8 is another example of a printer configuration. The difference with this embodiment is that the ink sheet rejuvenation mechanism is "downstream" of, or beyond, the thermal printing head. A feed roller 41 feeds out ink sheet 51. A print head assembly 42 prints images on paper with ink by means of a thermal transfer system 42. An ink supplying mechanism 43 supplies powder ink to ink sheet 51. A heat roller 44 sets (melts) the powder ink onto the ink sheet and it becomes permanently fixed. A take-up roller 45 rolls up the ink sheet 51 at the other end. Print head assembly 42 employs a thermal printing head 46 and a platen roller 47. Ink supply mechanism 43 employs an electrode roller 48, a sleeve 49 having a multi-pole magnet built inside a roller, and an electrode power supply 50.

During printing, ink sheet 51 travels in the forward direction, as indicated by an arrow 52, and images are formed on paper 53 by printing assembly 42. On the right of FIG. 8, supply mechanism 43 feeds powder ink 54 to ink sheet 51 and ink 54 is deposited in the areas where the ink layer has been used. The powder ink is then permanently fixed to ink sheet 51 by melting with heat roller 44. As a result, the powder ink is not permanent, between ink supply point "D" and ink fixing point "H" (called the DH interval below). The only thing holding the ink on is electrostatic force. When all of the ink sheet is fed out from feed roller 41 and thus is would onto take-up roller, the ink sheet can be reused by swapping feed roller 41 and take-up roller 45.

This results in a continuous rejuvenation of the ink sheet. An advantage of this embodiment is that the ink sheet has no ink gaps. Therefore, it is ready immediately to the printing section for printing. This results in a smooth printing initiation.

Figure 9:
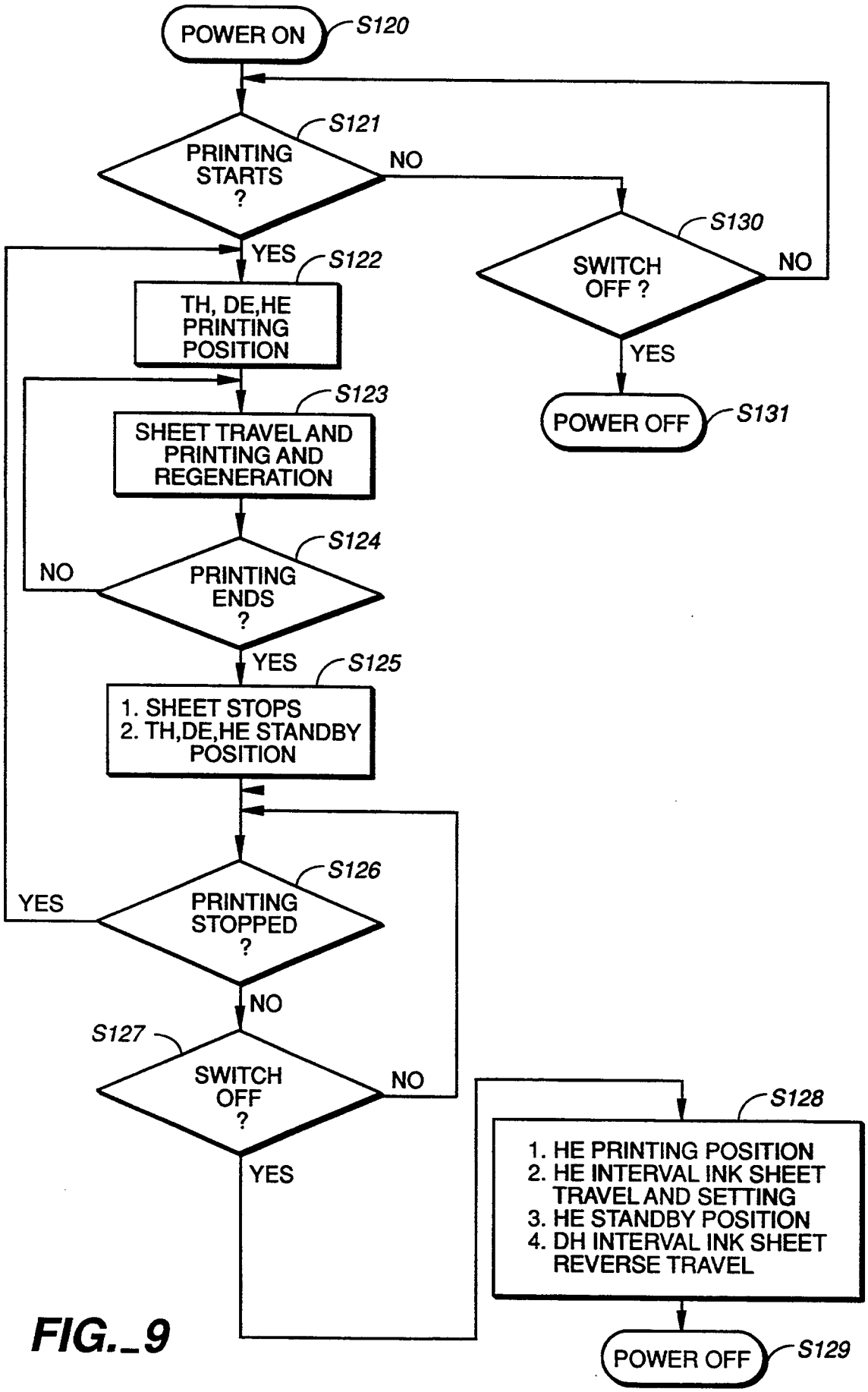
FIG. 9 is a flow chart of an exemplary method for controlling a part of the printer of FIG. 8.

FIG. 9 shows an exemplary method useful with the printer of FIG. 8. Printing mechanism 42 (also referred to as "Th") again employs thermal printing head 46 and platen roller 47. Ink feed mechanism 43 (also referred to as "De") again uses electrode roller 48 and sleeve 49. When a printing command is received (step S121) from an external source for example, from a host computer that gives commands to this printer, printing assembly 42, ink feed mechanism 43 and heat roller 44 move (step S122) from a point where they make no contact with the ink sheet (called their standby positions below) to a point where they each make contact with the ink sheet (called the printing positions). Ink sheet 51 then moves and printing coupled with ink sheet rejuvenation proceeds (step S123).

When a stop printing command is received from a host computer or the like (step S124), ink sheet 51 is stopped. Printing assembly 42, ink feed mechanism 43, and heat roller 44 all return to their respective standby positions (step S125). The printer then enters standby mode and waits for the next command.

If the power switch is turned off (step S127), the following steps (S128 and S129) occur. First, heat roller 44 is moved to its printing position. Ink sheet 51 is moved in its forward direction a distance from point "D" to point "H", as indicated in FIG. 8, and the ink on the ink sheet is permanently fixed. Afterwards, heat roller 44 returns to its standby position, and the ink sheet reverses and moves opposite to the direction of arrow 52 for a distance DH. The power to the printer is then turned off.

Once the power is on, if it is to be turned off again without printing, then no ink sheet is rejuvenated. However, before turning power off, all of the ink on the ink sheet needs to be permanently fixed. So, if the printer is not used for a long time, no variations in the thickness of the ink layer will occur as result of flaking of ink off of the ink sheet. This allows clear images without density variations to be obtained. This also prevents scattering of loose ink which can contaminate the inside of the printer. After the ink sheet has traveled in the forward direction and the ink has been permanently fixed, the ink sheet is then moved in the reverse direction. This allows the ink sheet feed length in the forward direction to be reduced to a minimum. It also reduces the number of times the ink sheet has to be flipped over.

Figure 10:
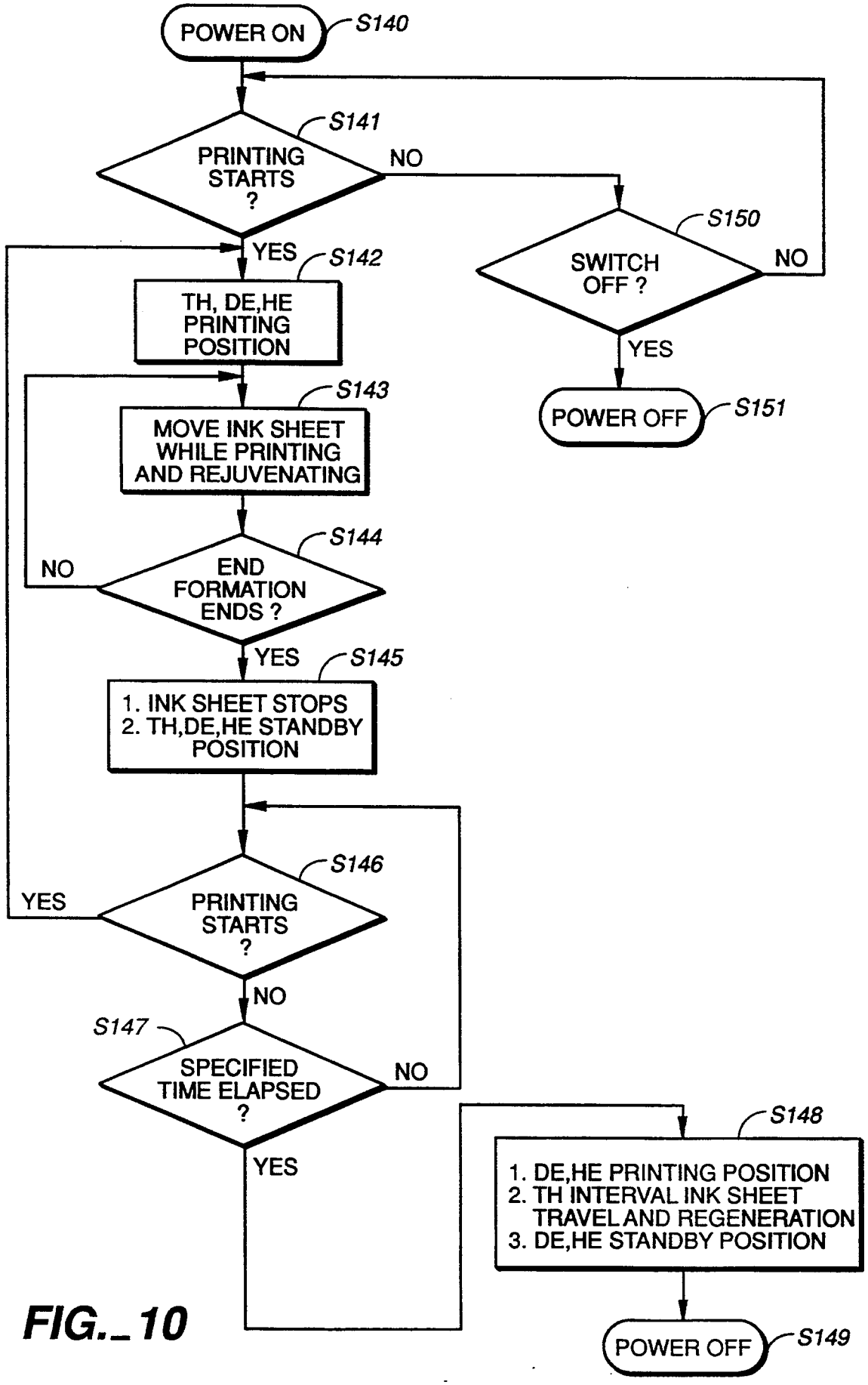
FIG. 10 is a flow chart of another method for controlling a part of the printer of FIG. 8.

FIG. 10 illustrates another method useful for operating the device of FIG. 8. When a command to begin printing is received from a host computer (step S141), printing assembly 42, ink feed mechanism 43, and heat roller 44 all will be moved from their standby positions to their respective printing positions (step S142). Then, ink sheet 51 moves while printing and rejuvenating (step S143) each occur. When a stop printing command is received from the host computer, ink sheet 51 stops moving. Printing assembly 42, ink feed mechanism 43, and heat roller 44 return to their respective standby positions (step S144 and S145) and the printer then enters standby.

When the power is turned off, the following steps are executed. First, ink feed mechanism 43 and heat roller 44 are moved to their printing positions (step S148). Next, ink sheet 51 is moved in its forward direction at least the distance from printing point "T" to fixing point "H" (distance TH) as indicated in FIG. 8. The ink sheet is thereby rejuvenated. Afterwards, ink feed mechanism 43 and heat roller 44 are returned to their standby positions and power is turned off (step S149). The reason for moving the ink sheet the distance TH is that anything shorter would cause parts of the ink sheet that had not been rejuvenated to be would up on to the take-up roller.

Simply moving the ink sheet in the forward direction when the power is to be turned off allows the ink to be permanently fixed. This allows the printer to be low cost, because of the simplicity of construction.

Figure 11:
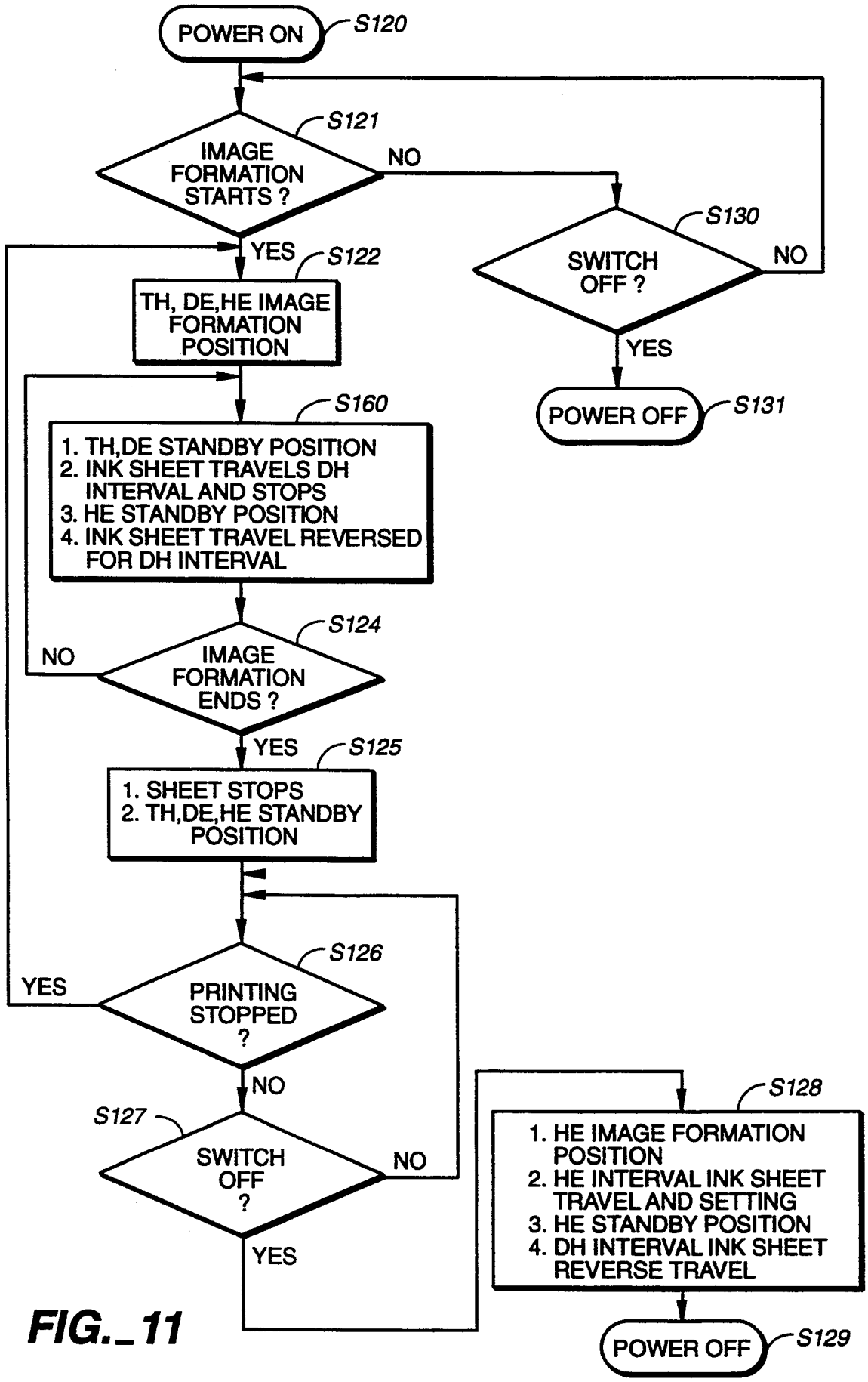
FIG. 11 is a flow chart of a variation of the method of FIG. 9.
Figure 12:
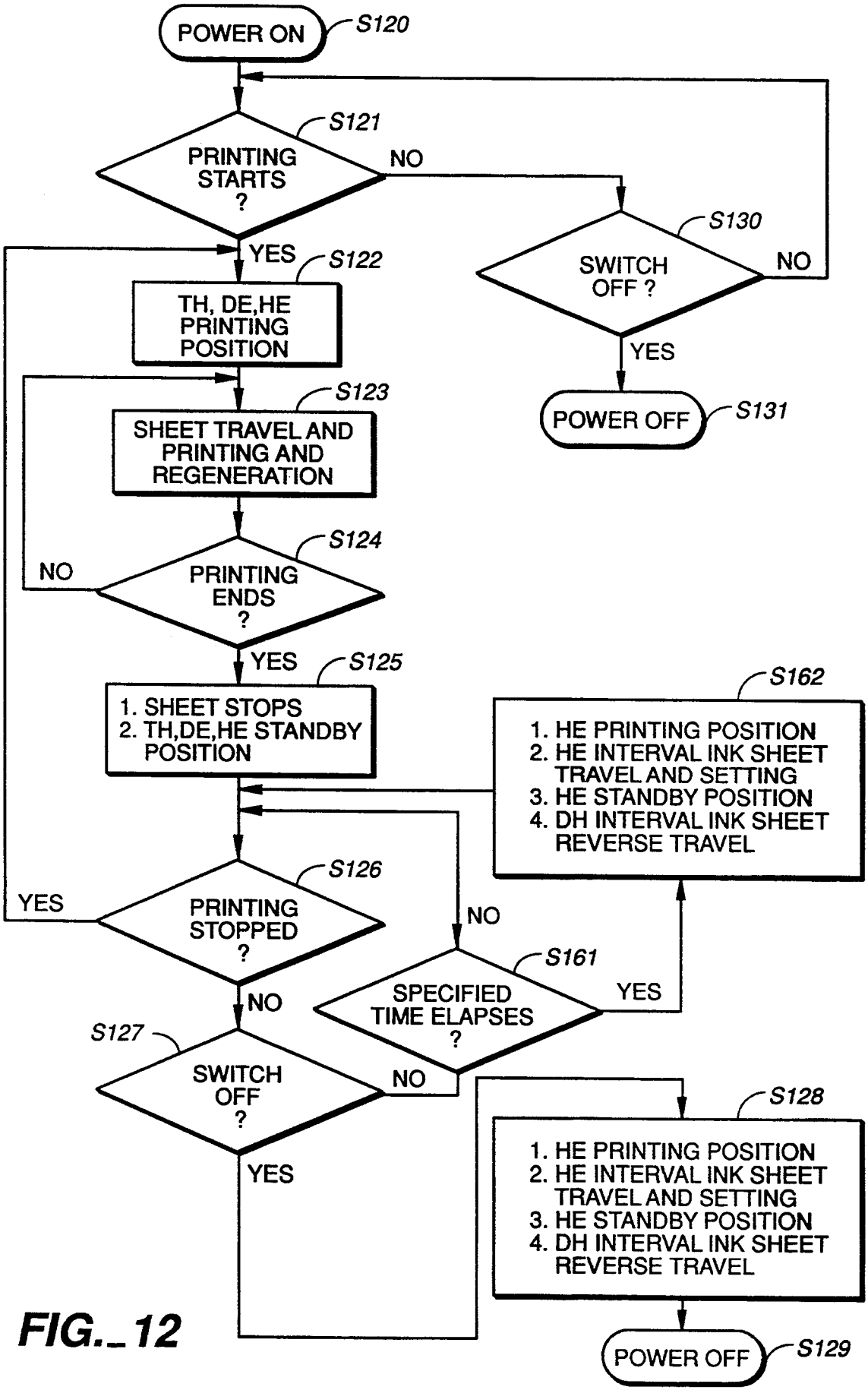
FIG. 12 is a flow chart of another variation of the print control method of FIG. 9.

FIGS. 11 and 12 each improve upon the method of FIG. 9. In each figure, identical steps use the same reference numbers. The difference between the method of FIG. 11 and that of FIG. 9 is that even when a stop printing command is received from the host computer, the fixing of the ink on the ink sheet (step S160) proceeds in the same manner as when a power switch is turned off (step S128). A difference between the method of FIG. 12 and that of FIG. 9, is that even when the standby time exceeds a specified time (step S161), powder ink is fixed by melting (step S162). During long periods of standby operation, the ink must be fixed (melted) within eight hours.

Figure 13:
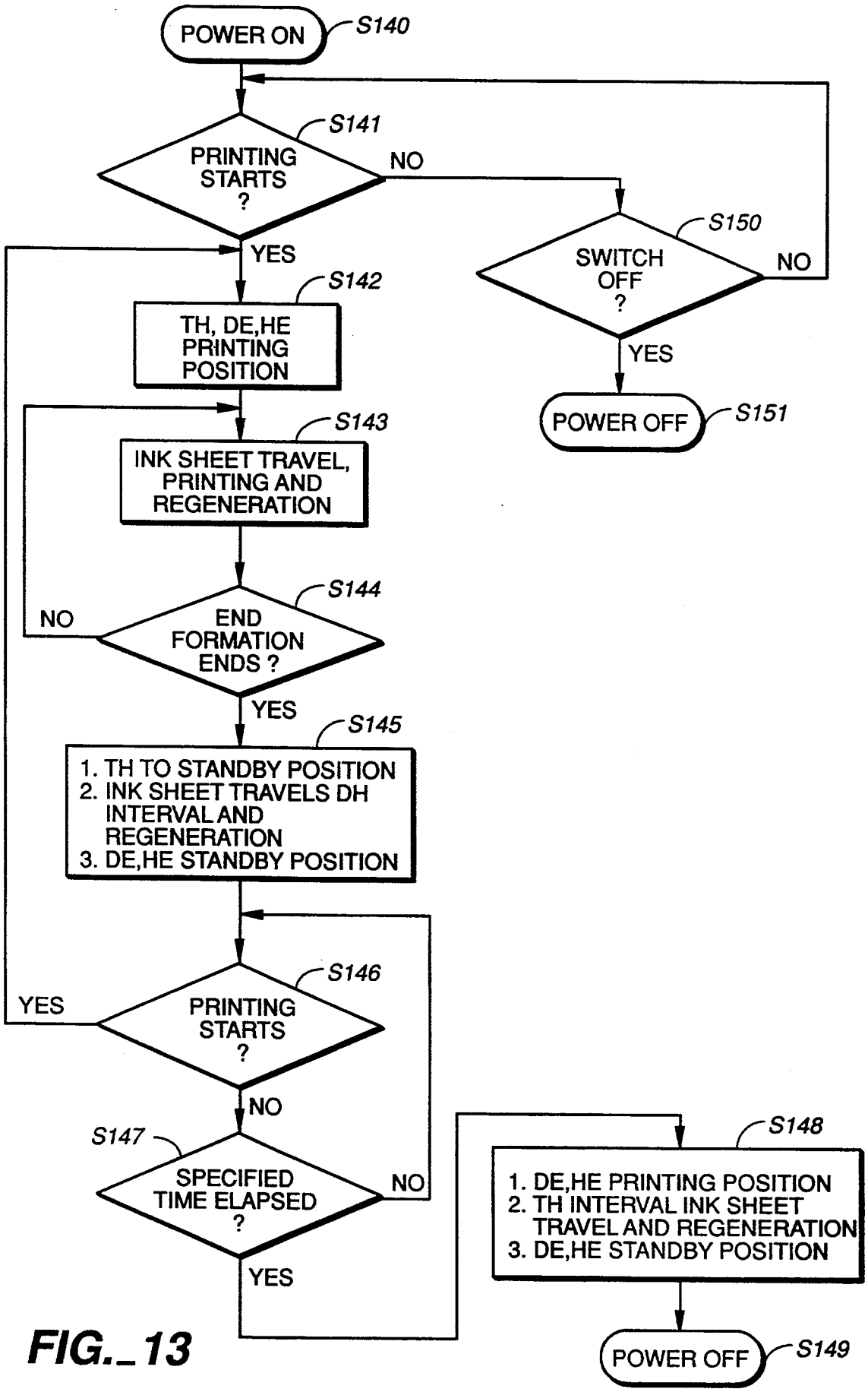
FIG. 13 is a flow chart of a variation of the method of FIG. 10.
Figure 14:
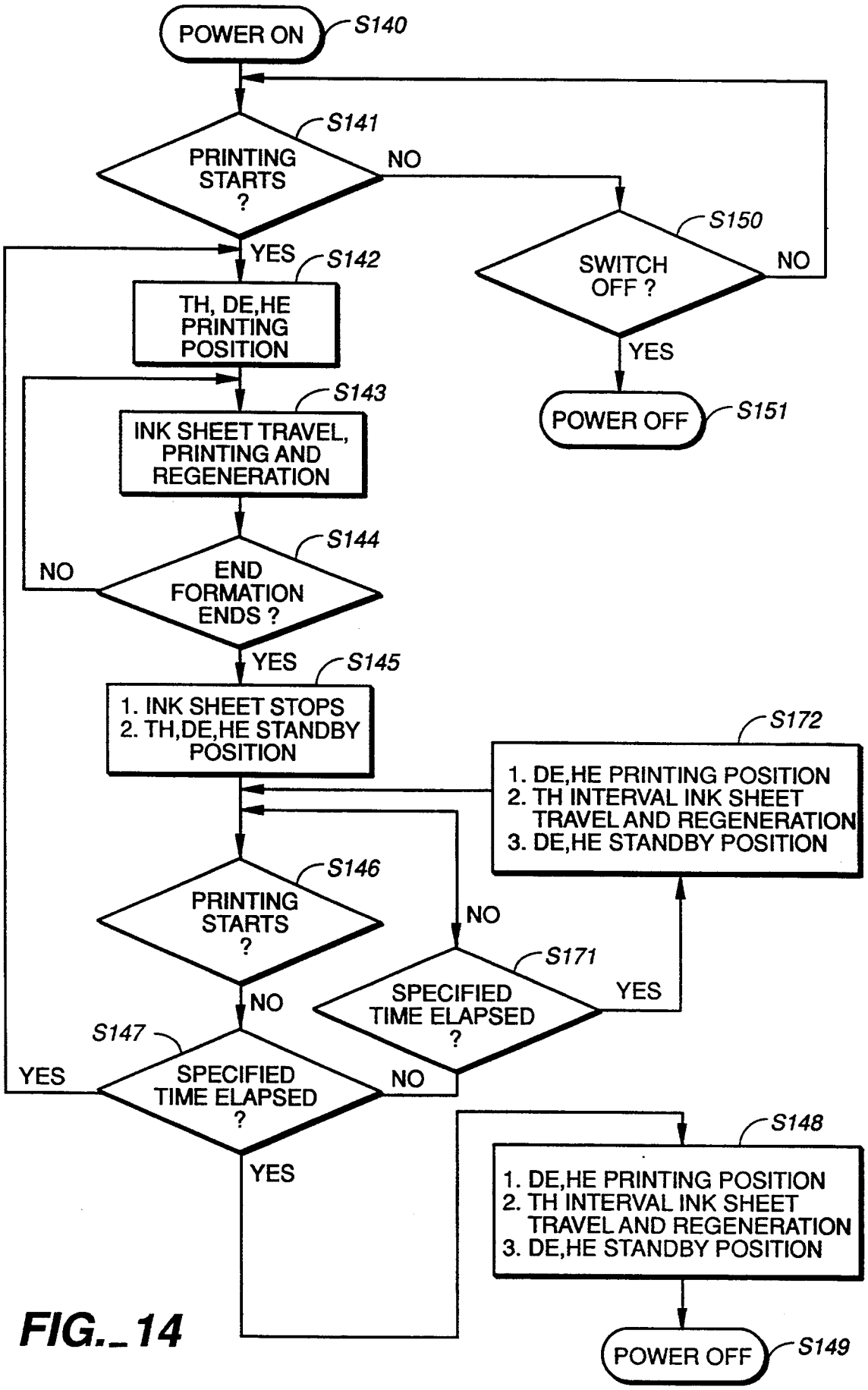
FIG. 14 is a flow chart of another variation of the method of FIG. 10.

FIGS. 13 and 14 each show an improvement over the method of FIG. 10. Those steps in FIGS. 13 and 14 that are identical to those in FIG. 10, use the same reference numbers. In the method of FIG. 13, when a stop printing command is received from the host computer, ink sheet rejuvenation (step 170) is performed the same as when power is turned off (step S148). In the method of FIG. 14, ink sheet rejuvenation (step S172) is done even when the standby time exceeds the specified time (step S171).

Figure 15:
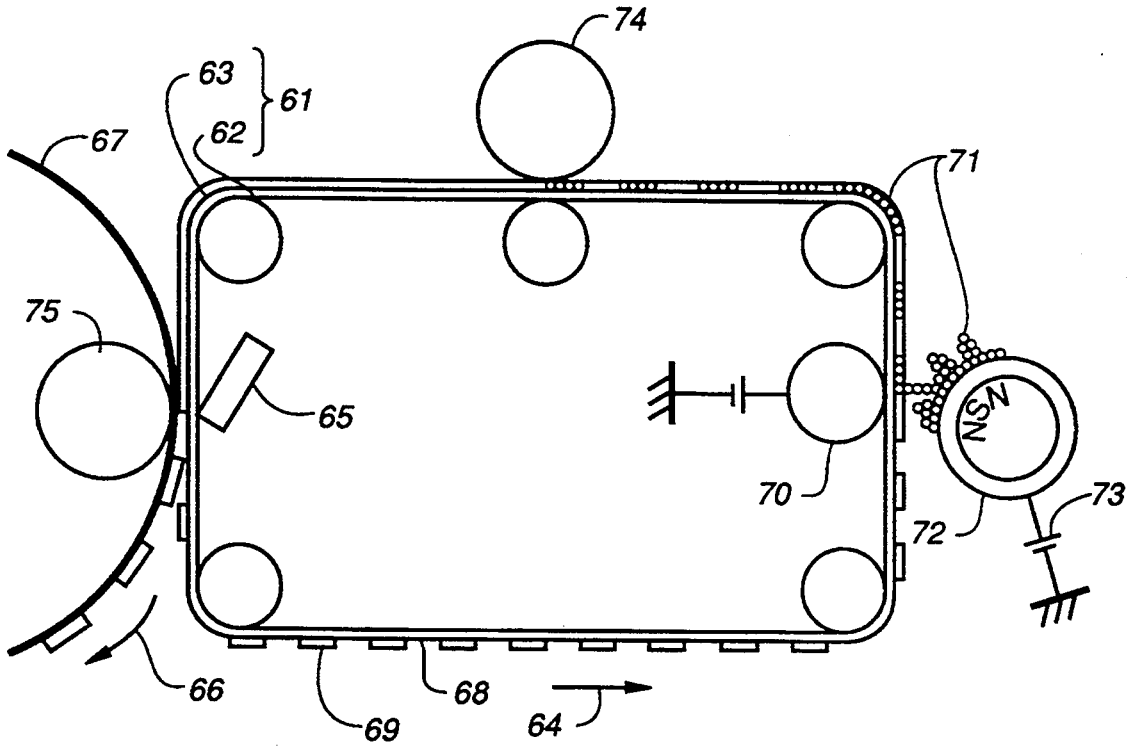
FIG. 15 is a diagram of a continuous-belt ink sheet printer embodiment according to the present invention.

FIG. 15 shows another embodiment of a printer using the present invention. This embodiment is characterized by the use of a continuous-belt ink sheet. As shown in FIG. 15, a continuous-belt ink sheet 61 is used having an ink layer 63 disposed on an insulating (dielectric) base layer 62. When continuous-belt ink sheet 61 moves in the direction of arrow 64, it comes into contact with thermal printing head 65 and paper 67. Paper 67, moves in the direction of arrow 66. Thermal printing head 65 has heating elements that turn on and off, based on an image signal. Using image input signals, an image is printed in ink on paper 67.

As stated, an ink layer 63 rides on continuous-belt ink sheet 61. Areas 68 represent spots on the ink sheet that have been used in printing, and ares 69 are patches where ink still exists. In the ink rejuvenation section, electrode 70 is positioned such that it makes contact with base layer 62 of continuous-belt ink sheet 61. Powdered ink comes in contact with ink layer 63, which is on the outside of the ink sheet. Powdered ink is delivered by sleeve 72 from a reservoir of ink. Built into sleeve 72 is a multi-pole magnetic cylinder but other configurations are possible. When continuous-belt ink sheet 61 passes between electrode 70 and sleeve 72, while a bias voltage is being applied by a power supply 73, powder ink will be attracted to only the used parts of the ink sheet. Those resupplied parts of ink sheets 61 then move to heat roller 74, where the powder ink is fixed by melting the ink, as above. In addition to using thermal pressure deposition to permanently fix the ink, flash deposition can also be used.

Printing can take place concurrently with rejuvenation by repeating the steps given above. The materials used for base layer 62 are typically polymers such as polyethylene terephtalate, polyphenyl sulfide, polyimide and polyamide. These are polymer films with both dielectric and insulating properties. Besides these, any other material compatible with thermal printing and easy ink peel off can be used.

An advantage of using a continuous-belt ink sheet is that compact and light weight printers can be made. Because (1) the ink sheet reversing operation is not necessary, and (2) the ink sheet take-up roller is eliminated. The configuration of FIG. 15 has its ink sheet rejuvenation section both "upstream" and "downstream" of the thermal printing head, depending on how you look at it. As a result, in this embodiment, it is possible to apply any of the computer-implemented processing steps already described in relation to previous figures.

Figure 16:
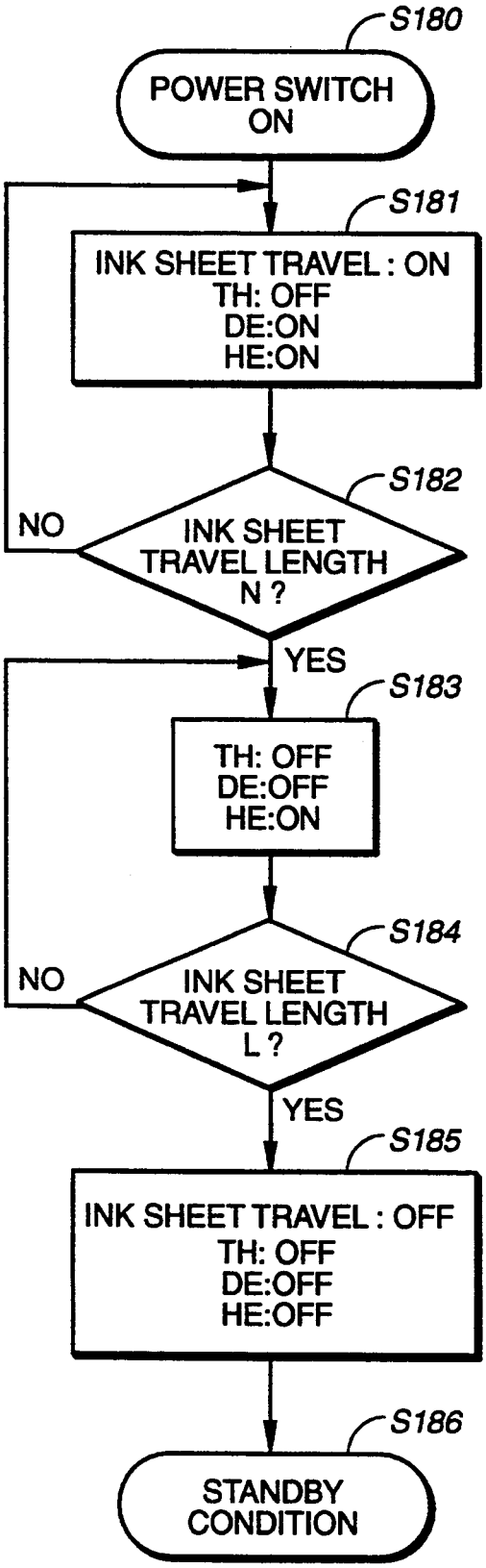
FIG. 16 is a flow chart of one exemplary method for controlling a part of the printer of FIG. 15.

Two computer-implemented methods that are especially effective with the printer of FIG. 15 are described below. FIG. 16 is a first such method. FIGS. 17A to 17D show the condition of the device at each of four steps during the execution of the first method. Printing assembly "Th" indicates the printing section, which uses a thermal printing head 65 and a platen roller 75. Ink feed mechanism "De" indicates the ink sheet feed section, which uses an electrode roller 70, sleeve 72, and power supply 73. Heat roller "He" indicates the ink fixing section, which contains heat roller 74.

Figure 17D:
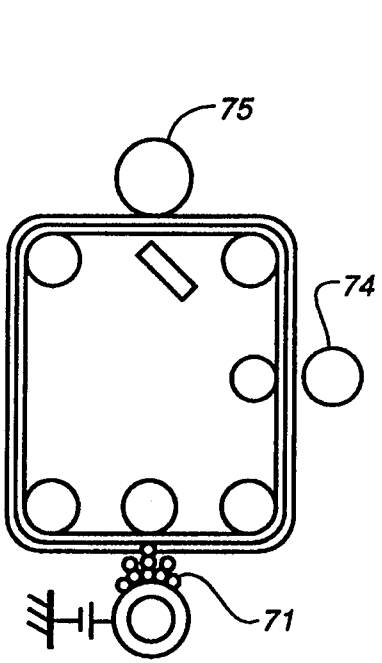
FIGS. 17A, 17B, 17C and 17D diagram four operational stages that match various points in the print control method of FIG. 16.
Figure 17C:
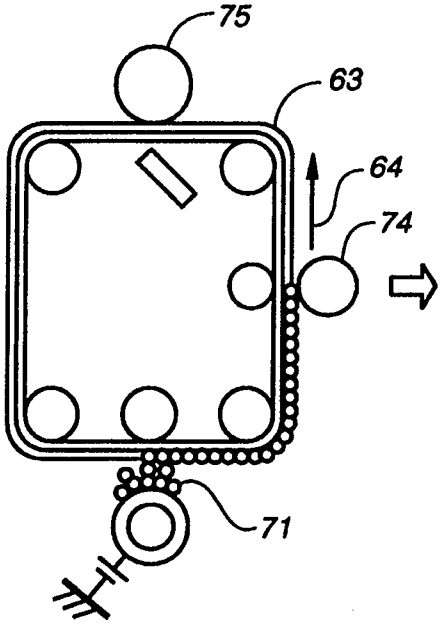
Figure 17B:
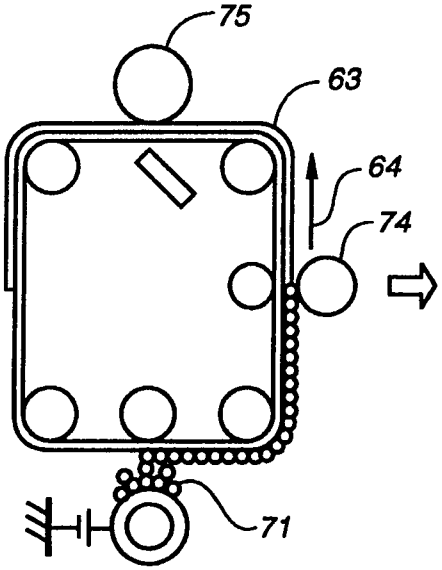
Figure 17A:
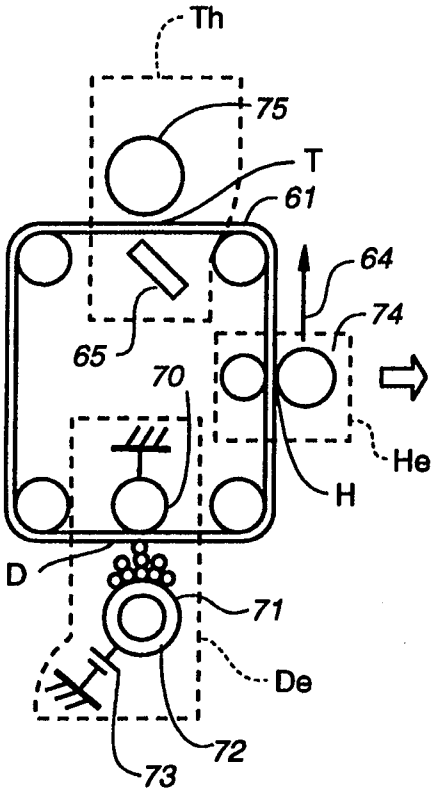

FIG. 17A shows the various printer mechanism conditions before a power switch is turned on. Here, continuous-belt ink sheet 61 is in a pre-rejuvenation condition. Where desire for a specific appication, the continuous-belt ink sheet 61 may only be the base layer, on which absolutely no ink layer has yet been formed. In the same diagram, points "T", "D" and "H" represent the printing point, the ink supply point and the fixing point, respectively.

As indicated in FIG. 17B, when the power switch is turned on, continuous-belt ink sheet 61 moves in the direction of arrow 64. Here, ink supply section ink feed mechanism De and ink fixing section heat roller 74 are in an operating mode, while printing section printing assembly Th is in a standby mode (steps S180 and S181). As a result, powder ink 71 is supplied to continuous-belt ink sheet 61 in ink supply section ink feed mechanism De. Powder ink 71 is formed into a thin layer in the ink fixing section by heat roller 74, forming ink layer 63 on continuous-belt ink sheet 61. While this rejuvenation operation is taking place, the continuous-belt ink sheet will move a distance M, its total length step (S182).

FIG. 17C shows a condition in which the ink sheet has traveled distance M, of its total length. Here, the top edge of ink layer 63, which is permanently fixed, is in ink supply position "D". After this, ink supply section ink feed mechanism De will enter standby mode (step S183). Next, continuous-belt ink sheet 61 will move in the direction of arrow 64 for distance L (step S184), which is between ink supply point "D" and ink fixing point "H". This will result in the powder ink deposited on the length of distance L fixing in fixing section heat roller 74, and as indicated on FIG. 17D. A complete layer of ink is, thus, formed on the entire length of the continuous-belt ink sheet.

After this, the continuous-belt ink sheet stops moving, the heater section is placed in standby mode and the printer enters standby mode, in which it waits for a command from the host computer to begin printing (steps S185 and S186). As aready explained in FIG. 15, when a printing command is received after this, printing will take place while rejuvenation of the ink sheet is taking place.

Figure 18:
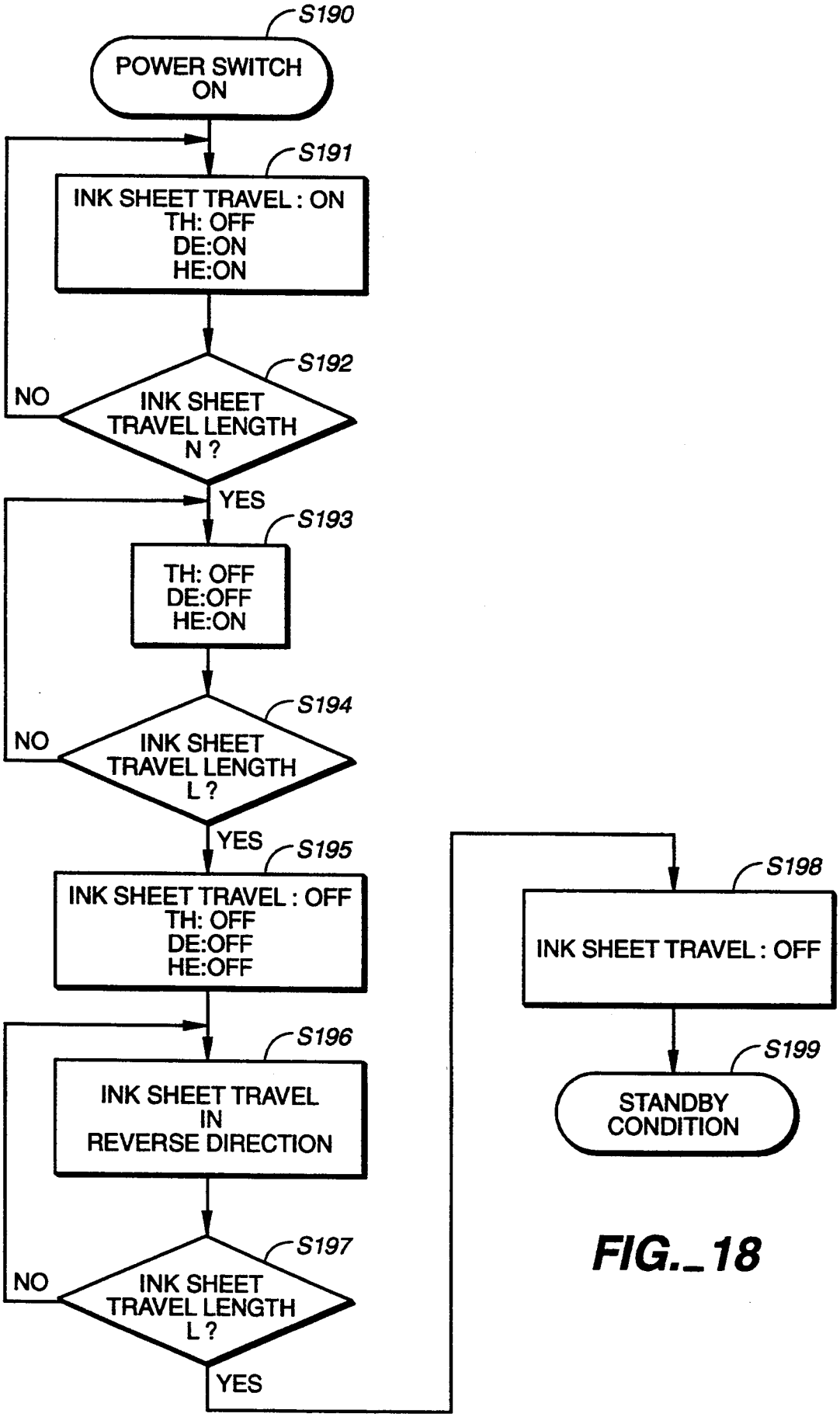
FIG. 18 is a flow chart of another method for controlling a part of the printer of FIG. 15.

FIG. 18 is a second method for operating the printer of FIG. 19. FIGS. 19A to 19D show the configuration of the printer during execution of steps of this second method. FIG. 19A shows the configuration of the device before power is turned on. Here, continuous-belt ink sheet 61 has either been used for printing or an ink layer has not been formed. Under such circumstances, detection of these conditions may be determined through use of ink layer detector 224 as described later in connection with FIG. 35.

Figure 19D:
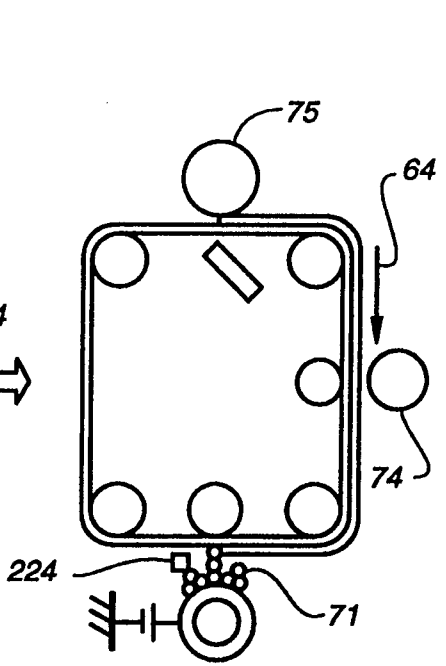
FIGS. 19A, 19B, 19C and 19D diagram four operational stages that match various points in the print control method of FIG. 18.
Figure 19C:
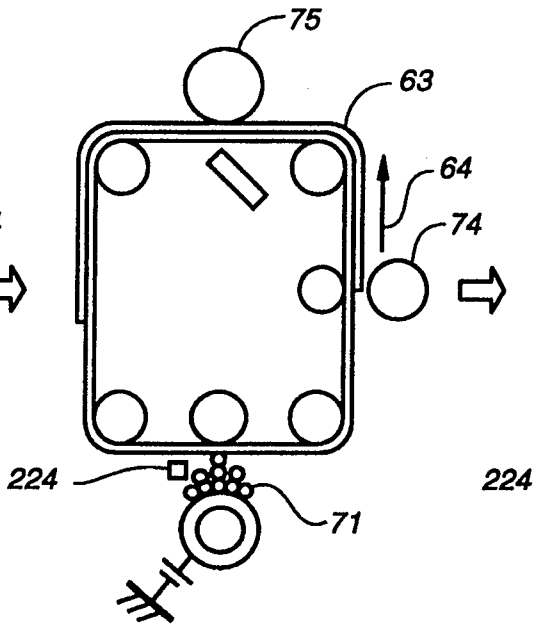
Figure 19B:
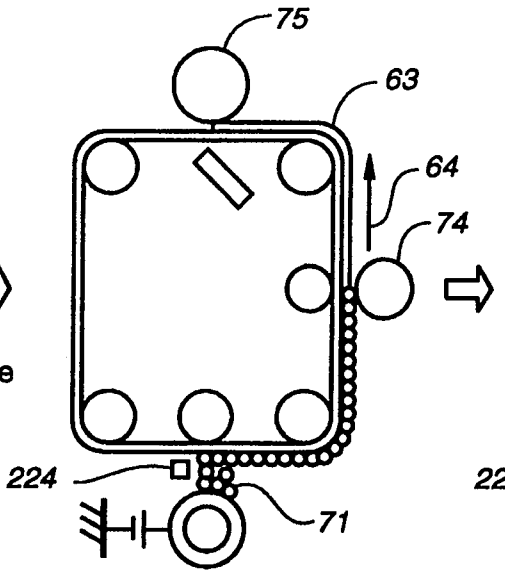
Figure 19A:
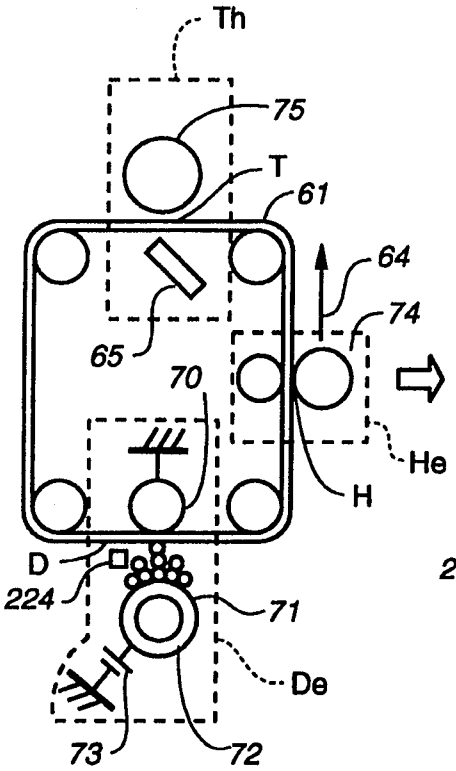

When the power switch is turned on, continuous-belt ink sheet 61 moves in the direction of arrow 64. Here, ink supply section ink feed mechanism De and ink fixing section heat roller 74 are in operating positions, while printing section printing assembly Th is in a standby position. A complete layer of ink layer is formed on continuous-belt ink sheet 61 (steps S190 and S191). Continuous-belt ink sheet 61 moves from printing point "T" a distance N, until it reaches ink supply point "D" (step S192). As indicated in FIG. 19B, this results in ink layer 63 being formed between printing point "T" and ink fixing point "H". Between ink fixing point "H" and ink supply point "D", the powder ink will have been deposited, but not yet permanently fixed.

After this, ink supply section ink feed mechanism De enters standby mode and continuous-belt ink sheet 61 moves distance L, the distance between ink fixing point "H" and ink suppy point "D", fixing the remaining powder ink (steps S193 and S194). As a result, a complete ink layer 63 is formed on continuous-belt ink sheet 61 for distance N, as indicated of FIG. 19C.

After this, ink fixing section heat roller 74 enters standby and continuous-belt ink sheet 61 travels distance L in the direction of arrow 76 (steps 196, 197 and S198), Which is opposite its direction of move until now. As shown of FIG. 19C, the result is that a complete layer of ink is formed on continuous-belt ink sheet 61 for distance N.

Subsequently, ink fixing section heat roller 74 enters standby mode and continuous-belt ink sheet 61 travels distance L in the direction of arrow 76 (steps S196, S197 and S198), which is opposite to the previous direction of movement. As shown in FIG. 19D, the result is that the printer enters a printing enable configuration and waits for a command from the host computer to begin printing.

Concerning the above two approaches, it is also acceptable to only have them take place when the power is turned on and there is only a base layer continuous-belt ink sheet, having no ink layer.

Control circuits for implementing these methods using computer-type commands and circuit elements are described next.

Figure 20:
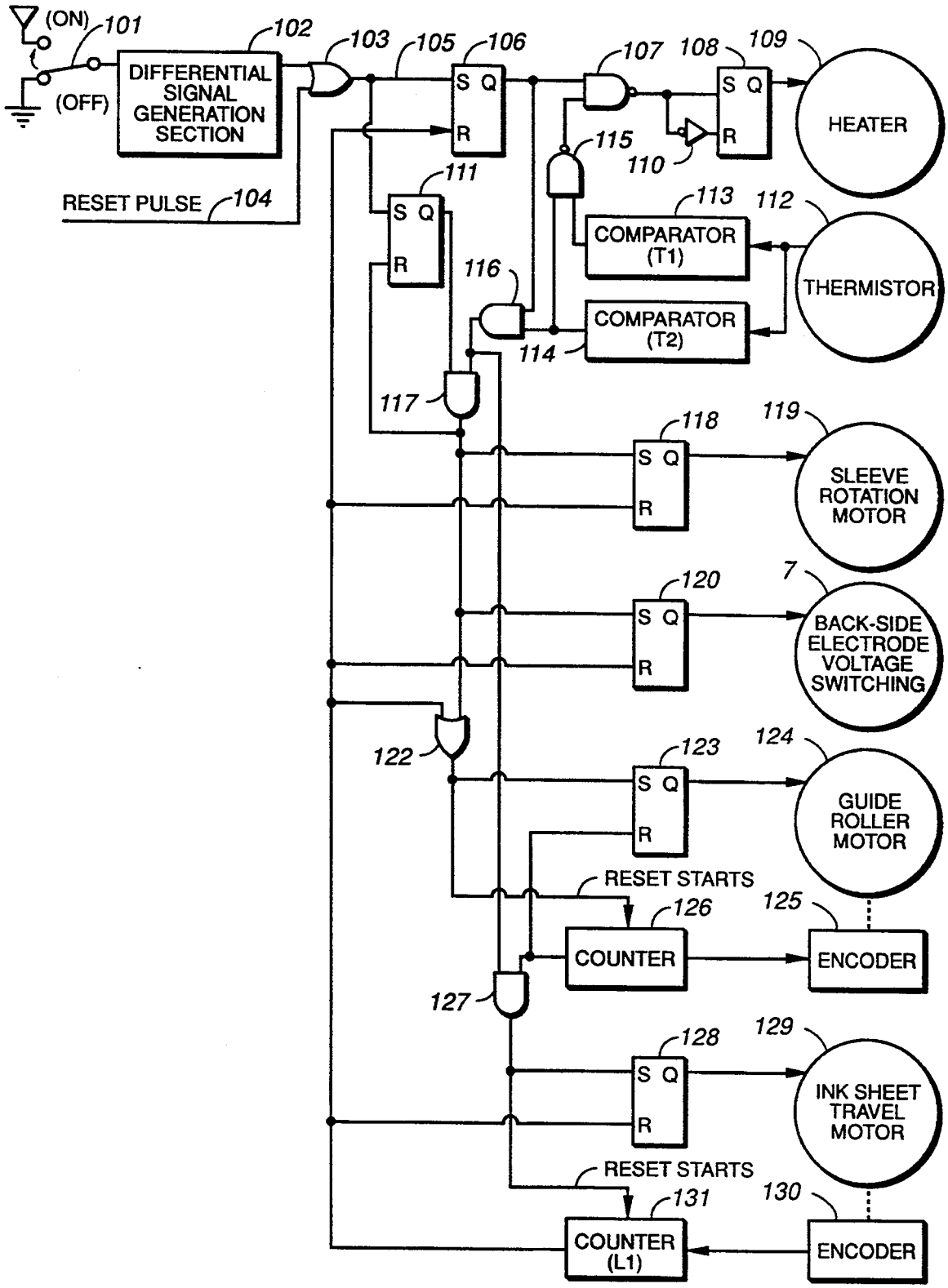
FIG. 20 and FIGS. 21–21B are schematic diagrams of some control circuits involved in the printing, control, and reset operations for the printer referenced in the method of FIG. 4.
Figure 21A:
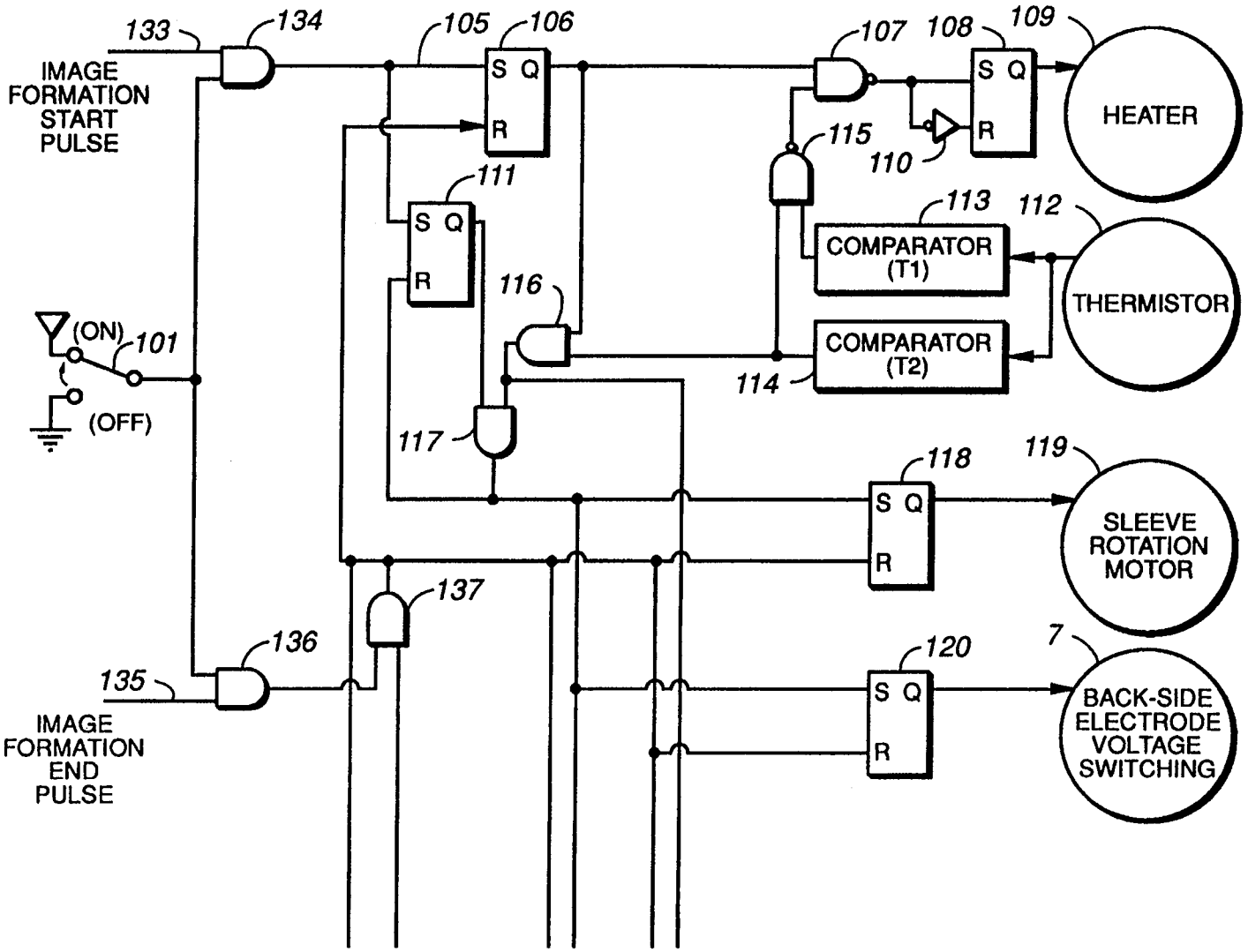
Figure 21B:
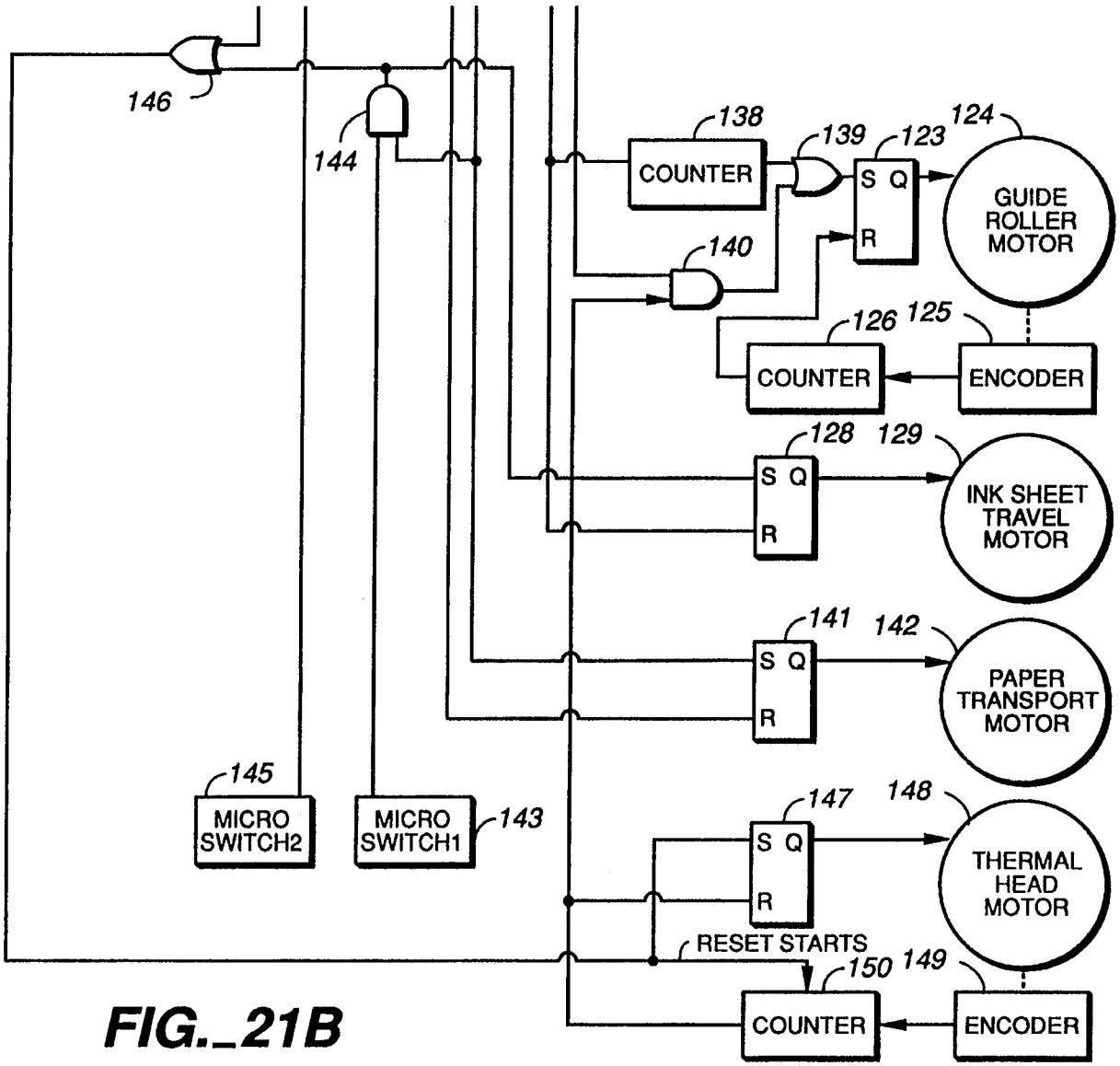
Figure 21:
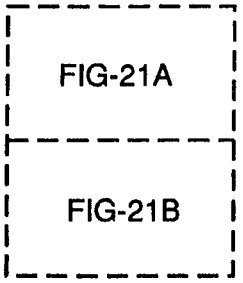

FIGS. 20 and 21 show control circuits for implementing the method of FIG. 4. FIG. 20 shows circuit components involved when the reset sequence (steps S1 to S15) is executed. FIG. 21 shows circuit components involved when the printing sequence (steps S16 to S35) is executed.

In FIG. 20, when power supply switch 101 is turned on, or when a reset pulse 104 is generated, for one of the various reasons already described, a reset signal 105 for the printer is generated by OR gate 103. This reset signal is fixed, latched, or set, by flip-flop circuits 106 and 111 for melting, as it is introduced to their set inputs. Setting flip-flop 106 also sets flip-flop 108, turning heater 109 on and heating up heat roller 9. The temperature of heat roller 9 is sensed by thermistor 112 as an electrical signal. Comparators 113 and 114 will then receive the sensed signal. Comparator 113 responds to a sensed signal of temperture T1, which is sightly higher than temperature $T_O$, the appropriate temperature of heat roller 9. Comparator 114 responds to a sensed signal of temperature T2, which is slightly lower than temperature $T_O$. When the temperature of heat roller 9 exceeds temperature T1, heat roller 9 is turned off.

When the temperature of heat roller 9 exceeds temperature T2, an output signal from AND gate 117 goes high, setting flip-flop 118, starting the rotation of a sleeve rotation motor 119, then setting flip-flop 120, switching change-over switch 7, and applying voltage $V_b$ to back-side electrode roller 6. When flip-flop 123 is set, guide roller motor 124 starts and moves guide rollers 14 and 15 to the printing positions. Concurrently, counter 126 will begin counting the output pulses of rotary encoder 125, which is linked to guide roller motor 124.

When guide rollers 14 and 15 move to their printing positions, an output signal from counter 126 and an output signal from AND gate 127 go high. As a result, flip-flop 123 is reset, guide roller motor 124 stops, flip-flop 128 is set and ink sheet transport motor 129 starts. Concurrently, counter 131 will be begin counting the output pulses of rotary encoder 130, which is linked to ink sheet transport motor 129.

When the distance of movement for the ink sheet reaches distance L, an output signal from counter 131 goes high. As result, flip-flop circuits 106, 118, 120 and 128 are all reset, thereby turning off heat roller 109, stopping the rotation of sleeve 19, grounding back-side electrode roller 6 and stopping the movement of the ink sheet. Then, flip-flop 123 will be set and guide roller motor 124 will rotate, causing guide rollers 14 and 15 to return to their standby positions.

Next, the circuit configurations of FIG. 21 are described. In FIG. 21, the same elements as those of FIG. 20 have the same reference numbers.

When power is on and a printing start pulse is input from the host computer, flip-flop circuits 106 and 111 are set. As in FIG. 20, this causes heat roller 9 to turn on, and at the point where the temperature of heat roller 9 exceeds temperature T2, sleeve motor 119 starts, and change-over switch 7 will switch and voltage $V_b$ is applied to back-side electrode roller 6. In addition, flip-flop 141 is set, paper transport motor 142 will start, and the paper will feed.

When the paper is resting in the specified position, an output signal from AND gate 144 goes high so that micro switch 143 can detect the leading end of the paper and generate a rise in its output signal. As a result, flip-flop 128 is set and the ink sheet starts moving using ink sheet transport motor 129. Flip-flop 147 will then be set and thermal printing head 10 moves to its printing position by means of thermal printing head motor 148. When thermal printing head 10 reaches the printing position, an output signal from counter 150 goes high. This will reset flip-flop 147 and stop the movement of thermal printing head 10 as well as set flip-flop 123, start guide roller motor 124, and move guide rollers 14 and 15 to their printing positions. In this manner, printing commences.

When all of the paper is used, micro switch 145 will detect the end of the paper and its output signal goes high. Then, stop printing pulse 135 is input. When all of the paper is used up, an output signal from AND gate 137 goes high and flip-flop circuits 106, 118, 120, 128, and 141 will reset, turning heater 109 off, stopping the rotation of sleeve 19, and grounding back-side electrode roller 6. In addition, flip-flops 123 and 147 will be set for melting and guide rollers 14 and 15, and thermal printing head 10 are returned to their standby positions.

Figure 22:
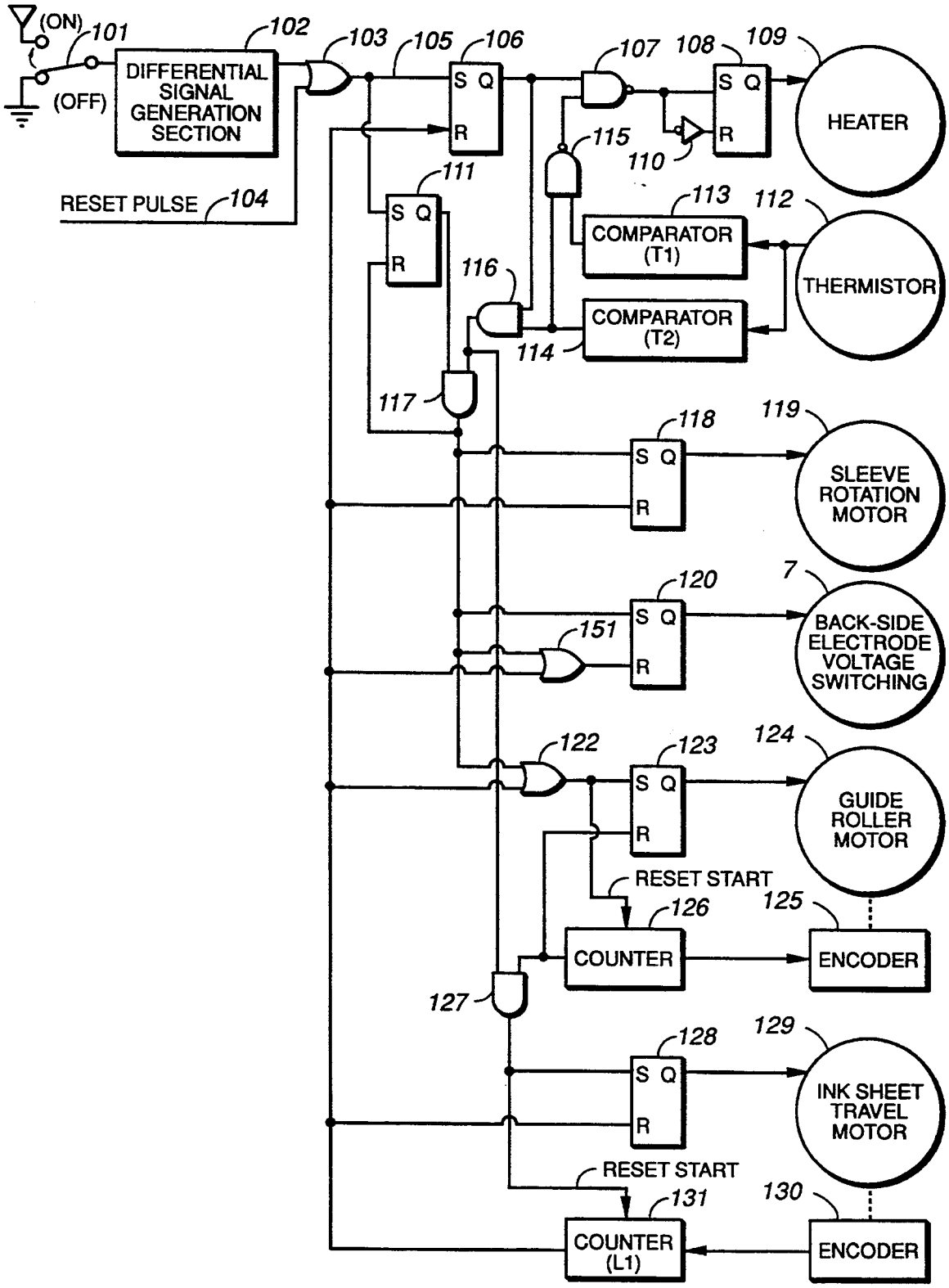
Figure 23B:
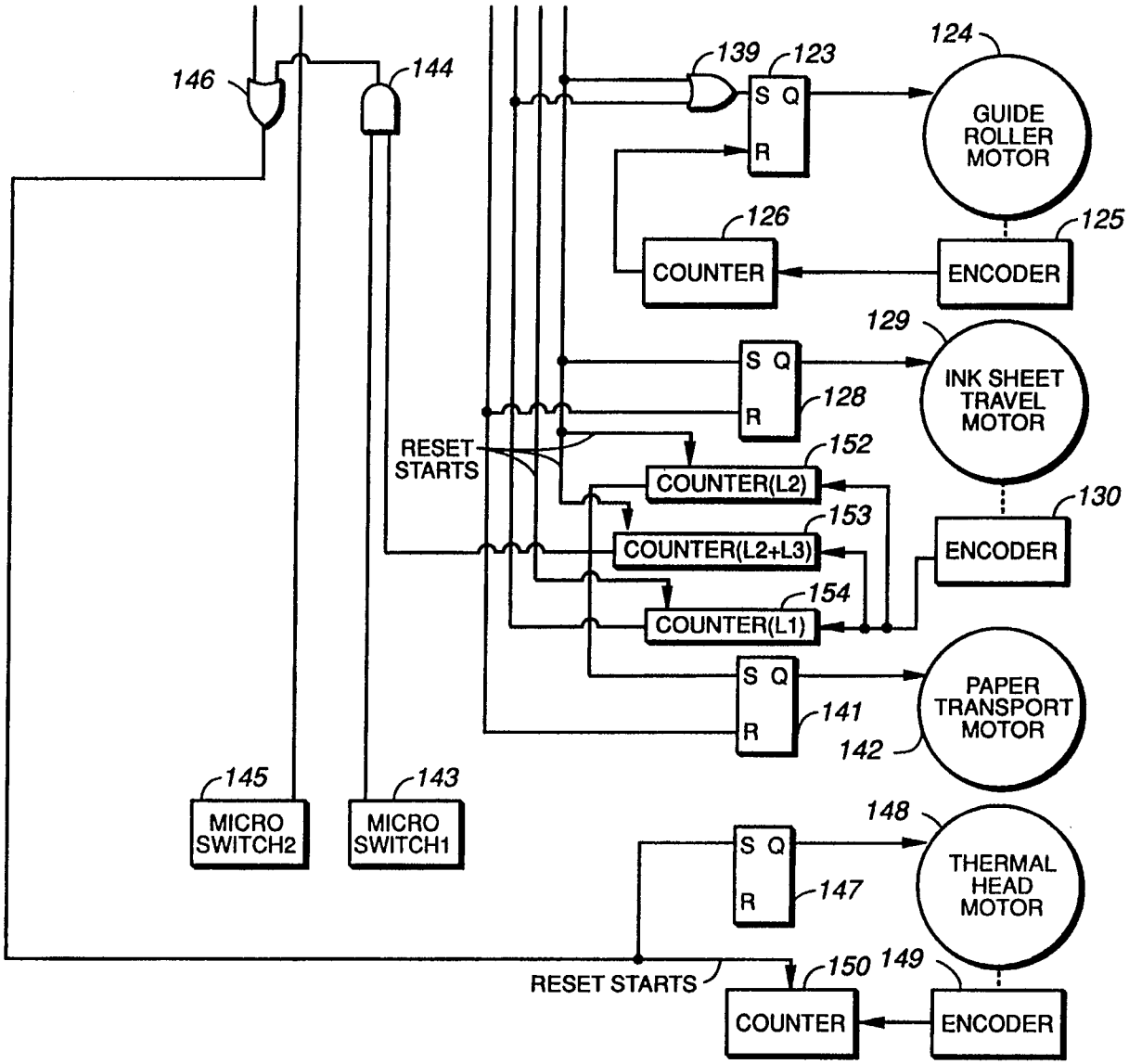

FIGS. 22 and 23 show control circuits useful for supporting the method of FIG. 6. FIG. 22 shows the circuits involved with the reset sequence (steps S40 to S53), while FIG. 23 shows the circuits involved with the printing sequence (steps S54 and S76).

The circuit configurations for FIG. 22 are largely the same as those of FIG. 20. The only difference is the operation of flip-flop 120, which controls change-over switch 7. As such, in FIG. 22, when reset signal 105 is generated, flip-flop 120 is reset, which results in back-side electrode roller 6 being grounded, stopping the supply of ink to the ink sheet and fixing of the ink.

In FIG. 23, with the power on, when a pulse to begin printing is received from the host computer, first heater 109 will turn on. When its temperature exceeds temperature T2, sleeve motor 119 starts, and voltage $V_b$ is applied to back-side electrode roller 6. In addition,, guide roller motor 124 will start and guide rollers 14 and 15 will move to their printing positions. Also, ink sheet transport motor 129 will start and ink sheet 3 starts (FIG. 1).

When ink sheet 3 has traveled distance L2, an output signal from counter 152 goes high, setting flip-flop 141, starting paper transport motor 142, and feeding the paper. When the installation of the paper has ended, the output signals of micro switch 143 and counter 153 go high, setting flip-flop 147, moving thermal printing head JO to the printing position and beginning printing.

When stop printing pulse 135 is input, the paper transport motor stops and thermal printing head transport motor 148 will start, moving thermal head 10 to a standby position. Change-over switch 7 will switch and back-side electrode roller 6 is grounded. Concurrently, counter 154 will begin operating and its output signal goes high at the point where ink sheet 3 has traveled distance L1. This causes flip-flop circuits 106, 118 and 128 to reset, turning heater 109 off and stopping sleeve rotation motor 119 and ink sheet transport motor 129. In addition , guide roller motor 124 will start again and return guide rollers 14 and 15 to their standby positions.

Figure 24:
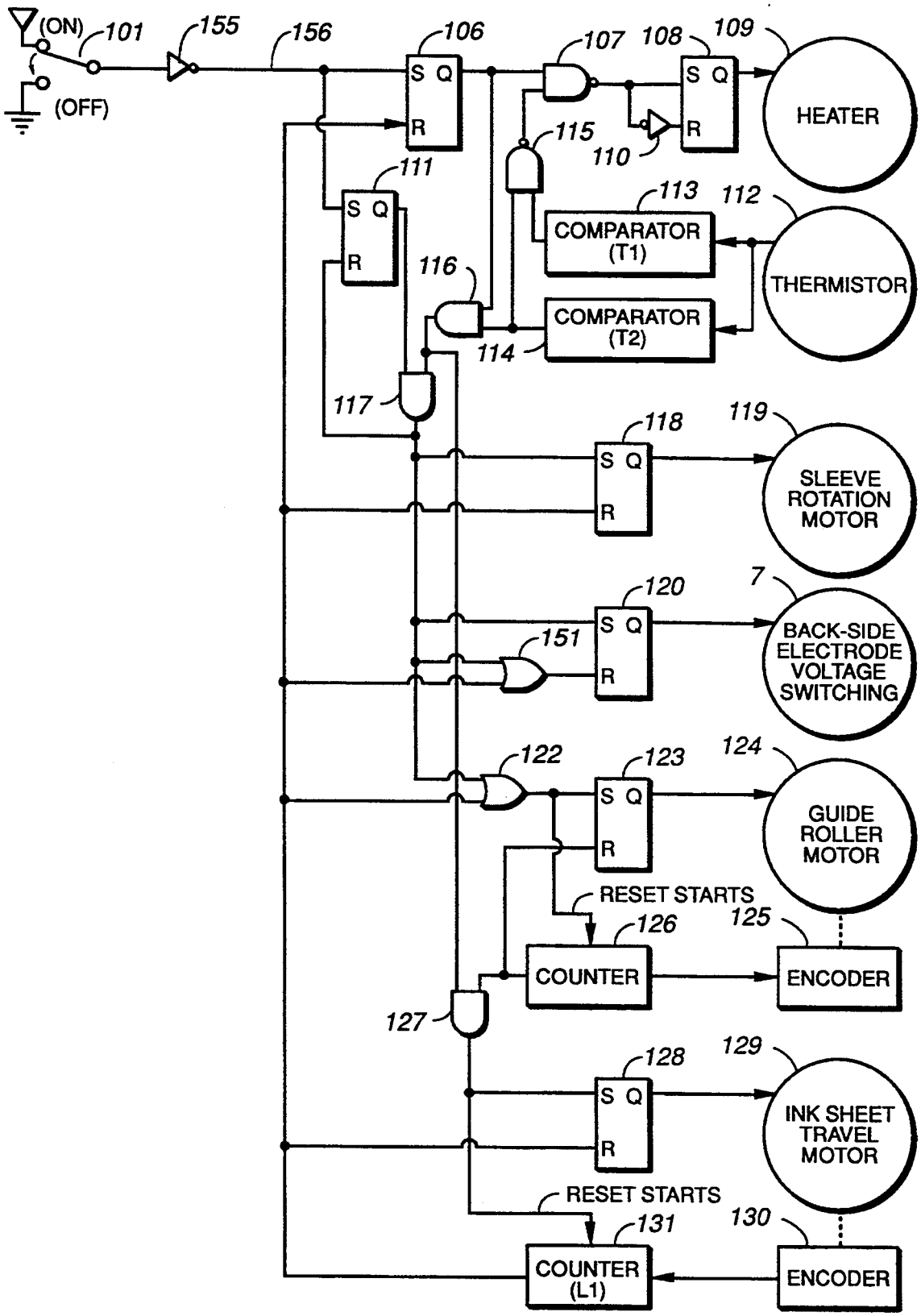
FIG. 24 is a schematic of circuits which are affected by a change for the power supply switch and which are referred to by the method of FIG. 7. The power supply switch is shown about to be turned off.

FIG. 24 shows the circuit components referred to in those steps for (steps S98 to S111) which the power switch of the control circuit that executes the method shown in FIG. 7 is off. The circuit components involved with this printing sequence (steps S81 to S97) of FIG. 7 are the same as FIG. 21.

Instead of the reset signal 105 of FIG. 22, the apparatus of FIG. 24 uses a signal 156, which is the inverse of an output signal from power switch 101. Therefore, when power switch 101 is turned off, heater 109 turns on and at the point where its temperature reaches temperature T2, sleeve rotation motor 119 starts and back-side electrode roller 6 is grounded. Guide roller motor 124 starts and guide rollers 14 and 15 move to their printing positions and the ink sheet starts. When the ink sheet has moved distance L1, an output signal from counter 131 goes high, and causes the printer to enter standby mode.

Figure 25:
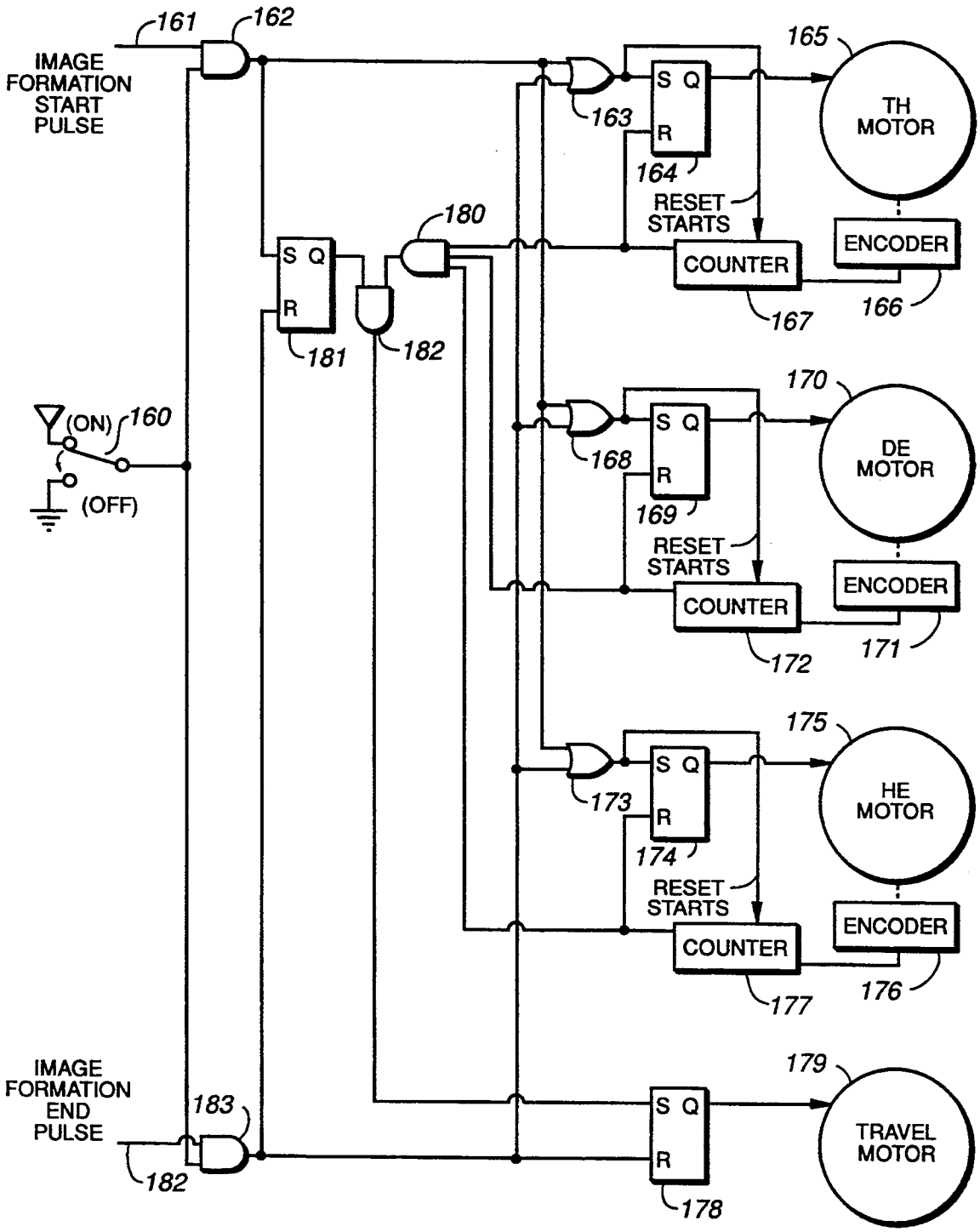
FIG. 25 and FIG. 26 are schematics of circuits which are affected by a change of the power supply switch and which are referred to by the method of FIG. 10. The power supply switch is showed about to be turned off.
Figure 26:
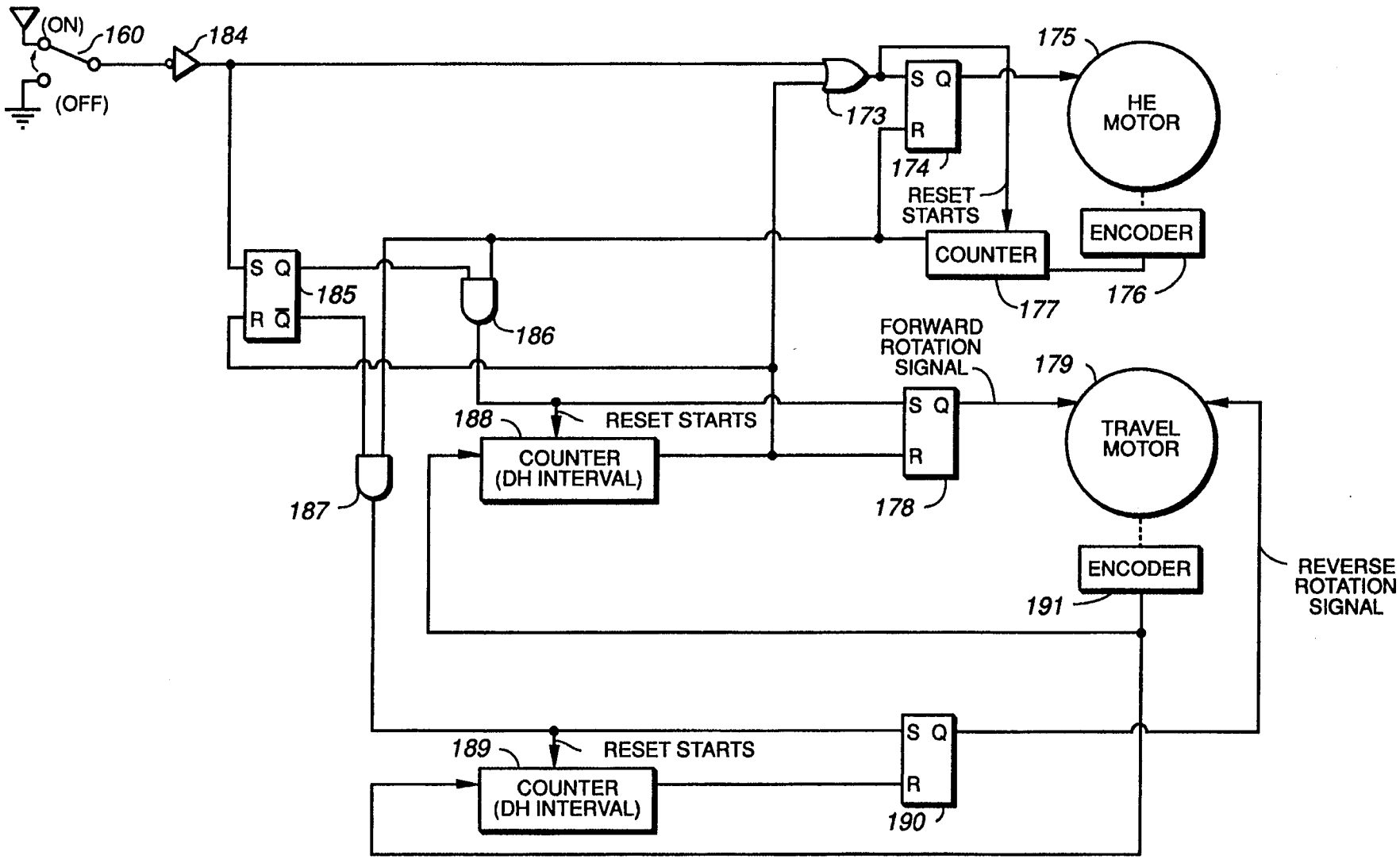

FIGS. 25 and 26 show exemplary control circuits that are able to support the method of FIG. 9. FIG. 25 shows circuits involved with the printing sequence (steps S120 to S126) and FIG. 26 shows circuits involved with the power off sequences (steps S127 to S129) after the end of printing. In FIG. 25, with power switch 160 on, a printing start pulse 162 is input from a host computer, flip-flop circuits 164, 169, and 174 are set which starts printing assembly 42 motor 165, motor 170 (in ink feed mechanism 43), and heat roller 44 motor 176. This causes printing assembly 42 ("Th"), ink supply mechanism 43 ("De"), and heat roller 44 ("He") to move to their respective printing positions. Concurrently, flip-flop 181 is set .

How much printing assembly 42, ink feed mechanism 43, and heat roller 44 each move is respectively detected by rotary encoders 166, 171, and 176. When each reach their respective printing positions, the output signals of counters 167, 172, and 174 go high. This causes an output signal from AND gate 182 to rise, setting flip-flop 178 and starting transport motor 179. The results is that the ink sheet and paper move at the start of printing and simultaneously ink sheet rejuvenation begins.

When a stop printing pulse is input from host computer, flip-flop 178 resets and the ink sheet stops moving. Concurrently, flip-flop circuits 164, 169, and 174 are set and printing assembly 42, ink feed mechanism 43, and heat roller 44 are returned to their standby positions.

In FIG. 26, when power switch 106 is turned off, 174 is set and heat roller 44 transport motor 175 starts. Concurrently, flip-flop 185 is set. When motor 175 (heat roller 44) moves heat roller 44 to its printing position, an output signal from counter 177 goes high which sets flip-flop 178 and transport motor 179. The result is that the sheet moves and powder ink on the ink sheet is fixed by melting.

Figure 27:
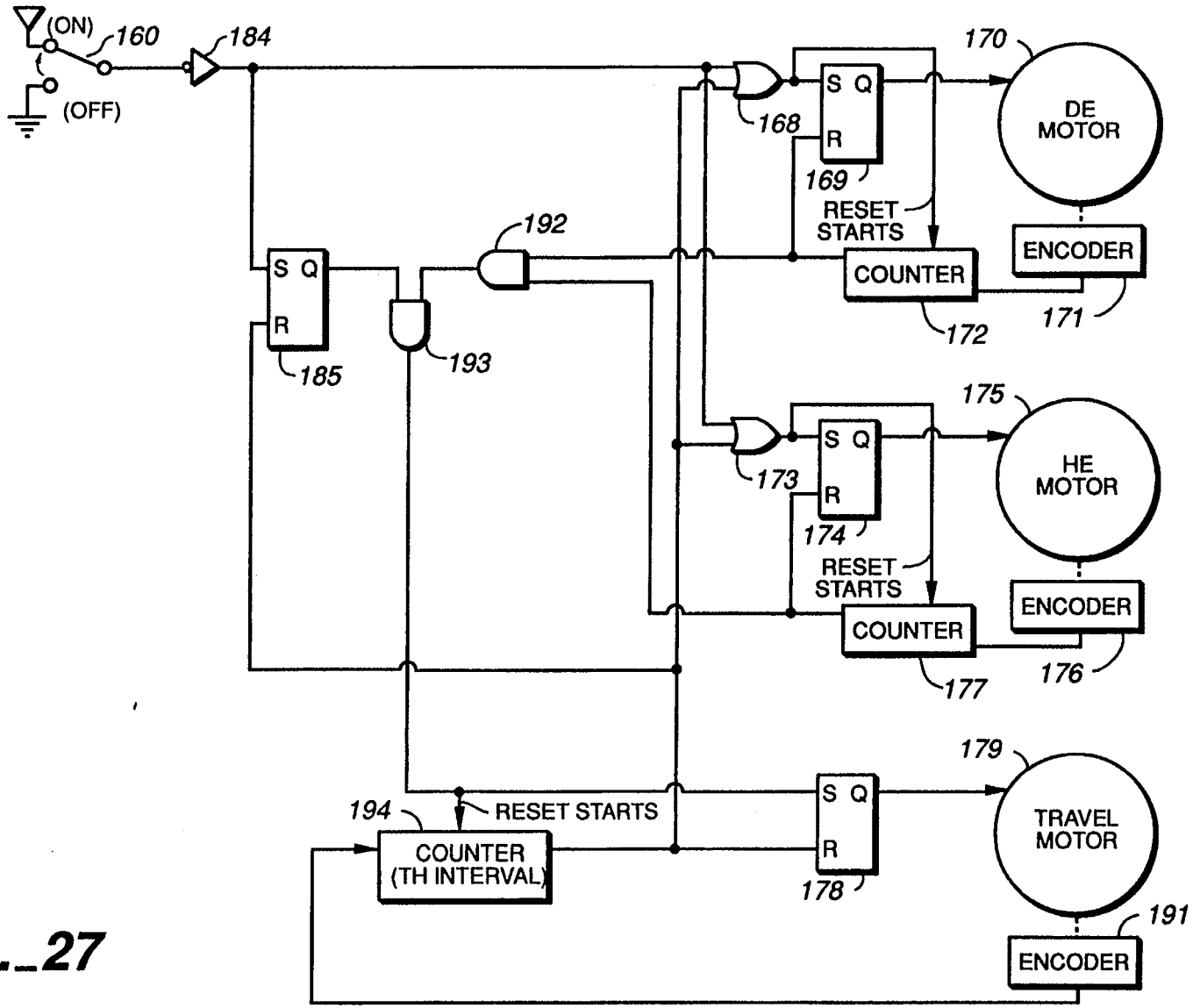
FIG. 27 is a schematic of circuits which are affected by turning off of a power supply switch, and which are referred to by the method of FIG. 10. The power supply switch is showed about to be turned off.

When the ink sheet has moved the length of the DH interval, an output signal from counter 188 goes high as determined from data via encoder 191. This causes flip-flop 178 to reset and stops transport motor 179. Concurrently, flip-flop 185 also resets, setting flip-flop 190, and transport motor 179 reverses, which moves the ink sheet backwards. When the ink sheet backs up the length of the DH interval, as determined from data via encoder 191 an output signal from counter 189 goes high, resetting flip-flop 190 and stopping transport motor 179. FIG. 27 shows the circuit components referred to in the processing steps (steps S147 to S149) occurring when the power switch of the control circuit supporting the method of FIG. 10 is turned off. The circuit components involved with method steps S140 to S146 of FIG. 10 are similar to those of FIG. 25.

In FIG. 27, when power switch 160 is turned off, motor 170 (ink feed mechanism 43), and motor 175 (heat roller 44), start up, and move ink feed mechanism 43 and heat roller 44 to their printing positions. When ink feed mechanism 43 and heat roller 44 reach their printing positions, the output signals of counters 172 and 177 go high. This causes motor 170 (ink feed mechanism 43) and motor 175 (heat roller 44) to stop. Concurrently, an output signal from AND gate 193 goes high, setting flip-flop 178 which starts transport motor 179. When transport motor 179 has caused the ink sheet to move the length of the DH interval, an output signal from counter 194 goes high and transport motor 179 stops.

Figure 28:
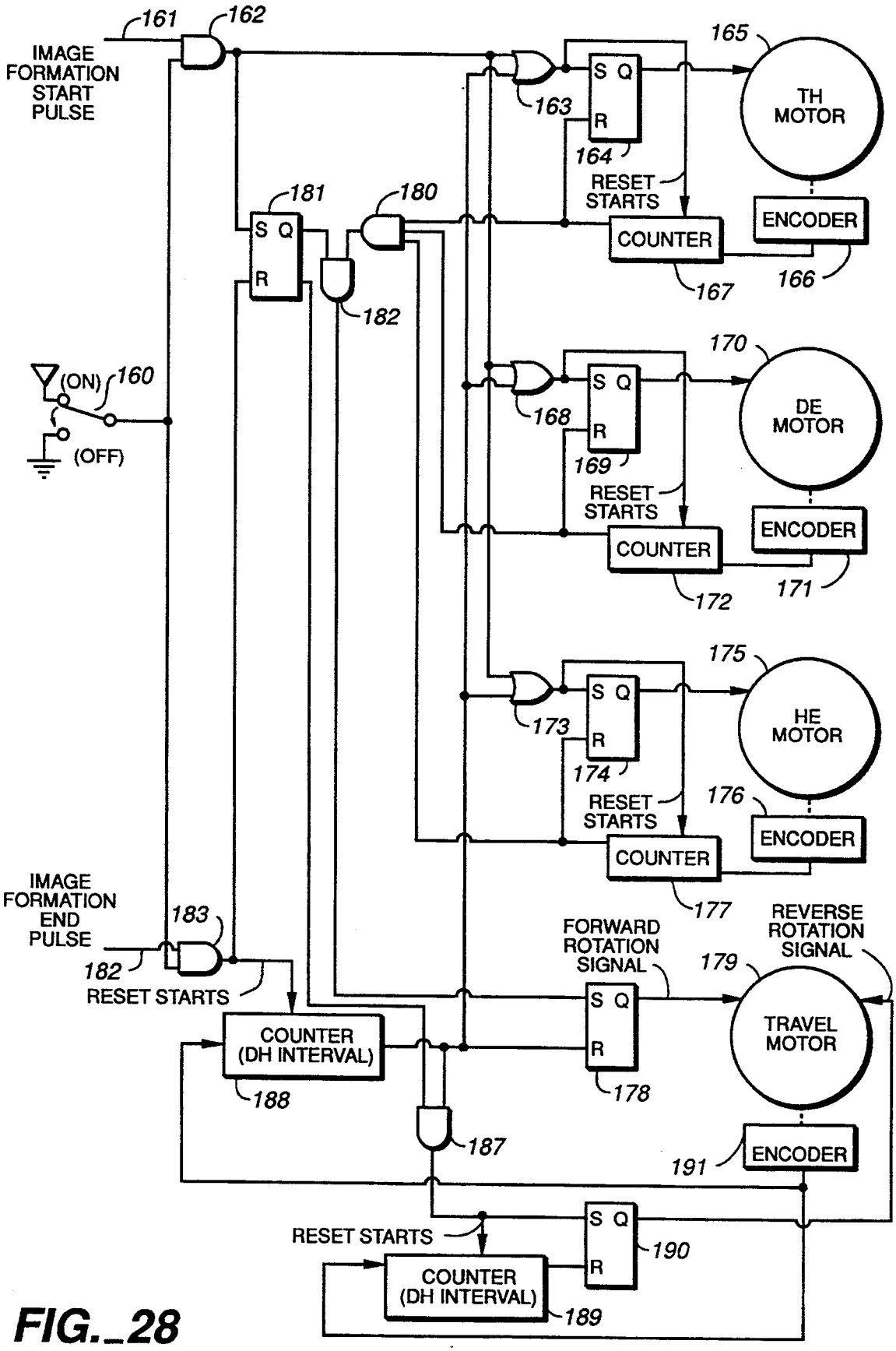
FIG. 28 is a schematic of circuits which are referred to by the method of FIG. 11 for controlling a part of the printer that forms images on paper.

FIG. 28 shows circuit components involved with the printing method (steps S120 to S126) that uses the supporting control circuit of FIG. 11. The circuit components involved with the power switch off sequence (steps S127 to S129) of FIG. 11 are about the same as those of FIG. 26. In FIG. 28, the steps after receiving the pulse that starts printing are about the same as those of FIG. 25. When a stop printing pulse is received , flip-flop circuits 164 and 169 are set, returning printing assembly 42 and ink feed mechanism 43 to their standby positions. Concurrently, flip-flop 181 is set and counter 188 starts to calculate the distance that transport motor 179 moves the ink sheet.

When the ink sheet movement distance equals the DH interval, an output signal from counter 188 goes high. This will set flip-flop 174 and return heat roller 44 to its standby position. An output signal from AND gate 187 goes high and sets flip-flop 190. This causes transport motor 179 to reverse direction and move the ink sheet in the opposite direction. When the distance the ink sheet travels backward equals the DH interval, an output signal from counter 189 goes high and resets flip-flop 190. This stops the ink sheet movement.

Figure 29:
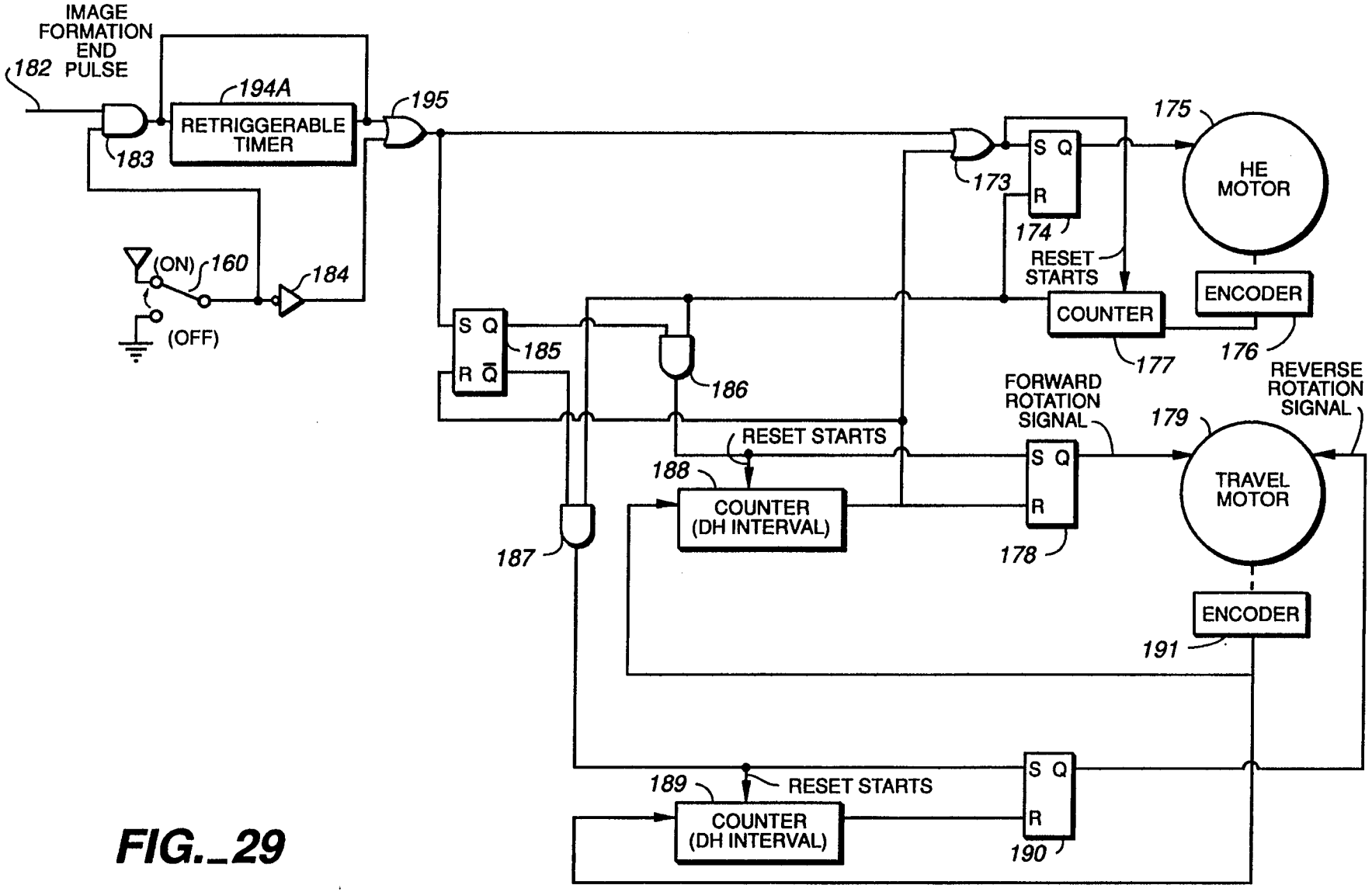
FIG. 29 is a schematic of circuits involved when the control circuit is at standby and when the power supply switch is turned off. These circuits are referred to in the method of FIG. 12.

FIG. 29 shows components that support the standby and the power switch turn off sequences (steps S161, S162 and S127 to S129) of FIG. 12. Those circuits involved with the printing sequence of FIG. 12 (steps S120 to S126) are similar to those of FIG. 25.

In FIG. 29, with the power switch 160 on, retriggerable timer 194 is triggered by a stop printing pulse 182 from a host computer. After a preset time, it outputs a pulse. This pulse will trigger timer 194. As long as timer 194 is standing by, it will output a periodic pulse (or clock). The steps that execute as a result are the same as those steps occurring when the power off, see FIG. 25. In addition, the steps that place when the power switch is turned off (FIG. 29) are similar to the steps of FIG. 25.

Figure 30:
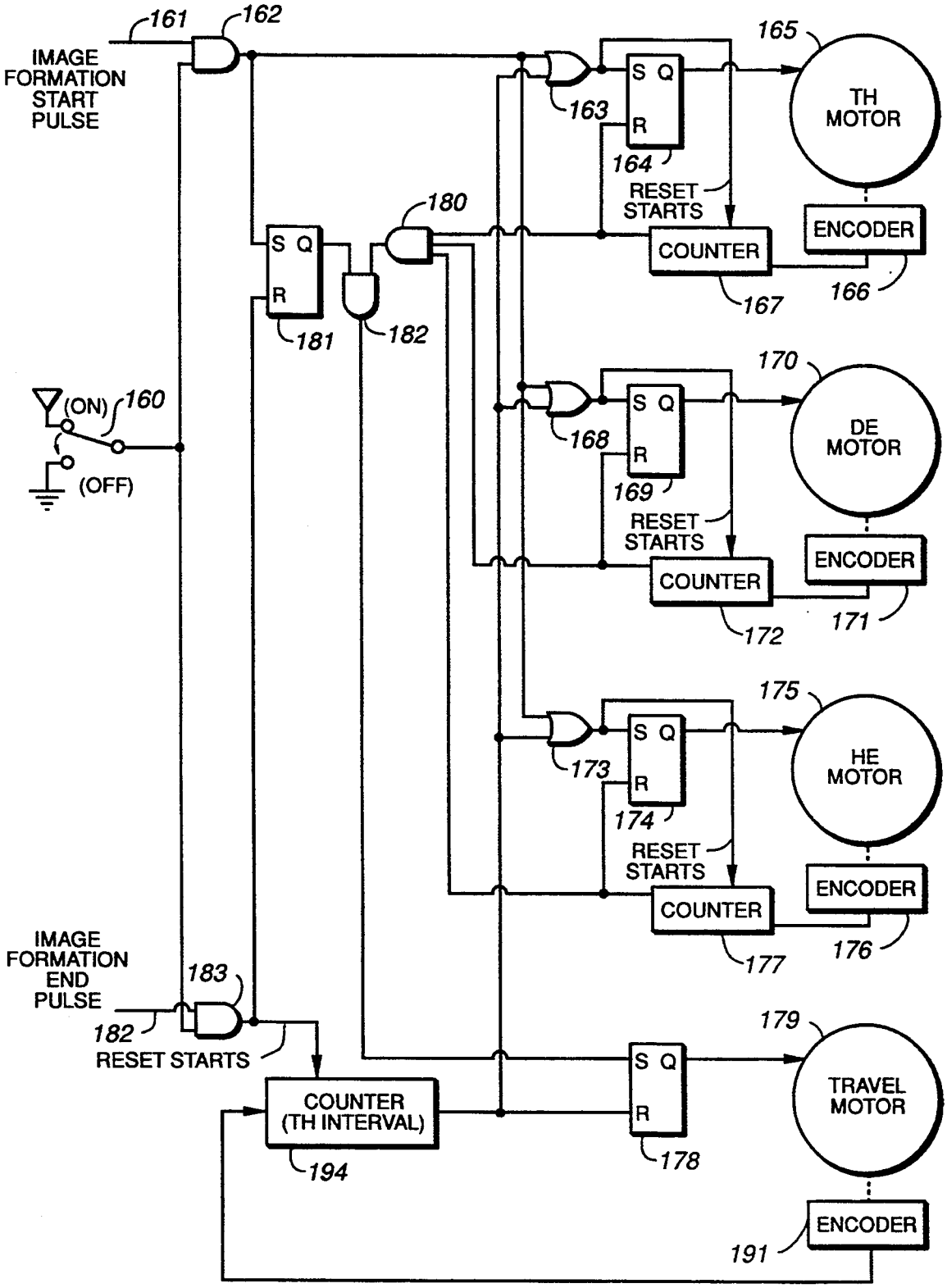
FIG. 30 is a schematic of circuits which are referred to by the method of FIG. 13 for controlling a part of the printer to form images.

FIG. 30 shows circuits that support the printing sequence (steps S140 to S146) of FIG. 13. The circuit used with the power switch turn off sequence (steps 147 to S149) of FIG. 13 is about the same as that of FIG. 27. FIG. 30 is similar to FIG. 25. When a stop printing pulse is input from a host computer, flip-flop 164 is set and printing assembly 42 returns to its standby position. Concurrently, counter 194 starts and measures the distance motor 179 moves the ink sheet. When the distances equals the TH interval, an output signal of counter 194 goes high, resetting flip-flop 178 which stops the ink sheet. In addition, flip-flop circuits 169 and 174 are set, and ink feed mechanism 43 and heat roller 44 are returned to their standby positions.

Figure 31:
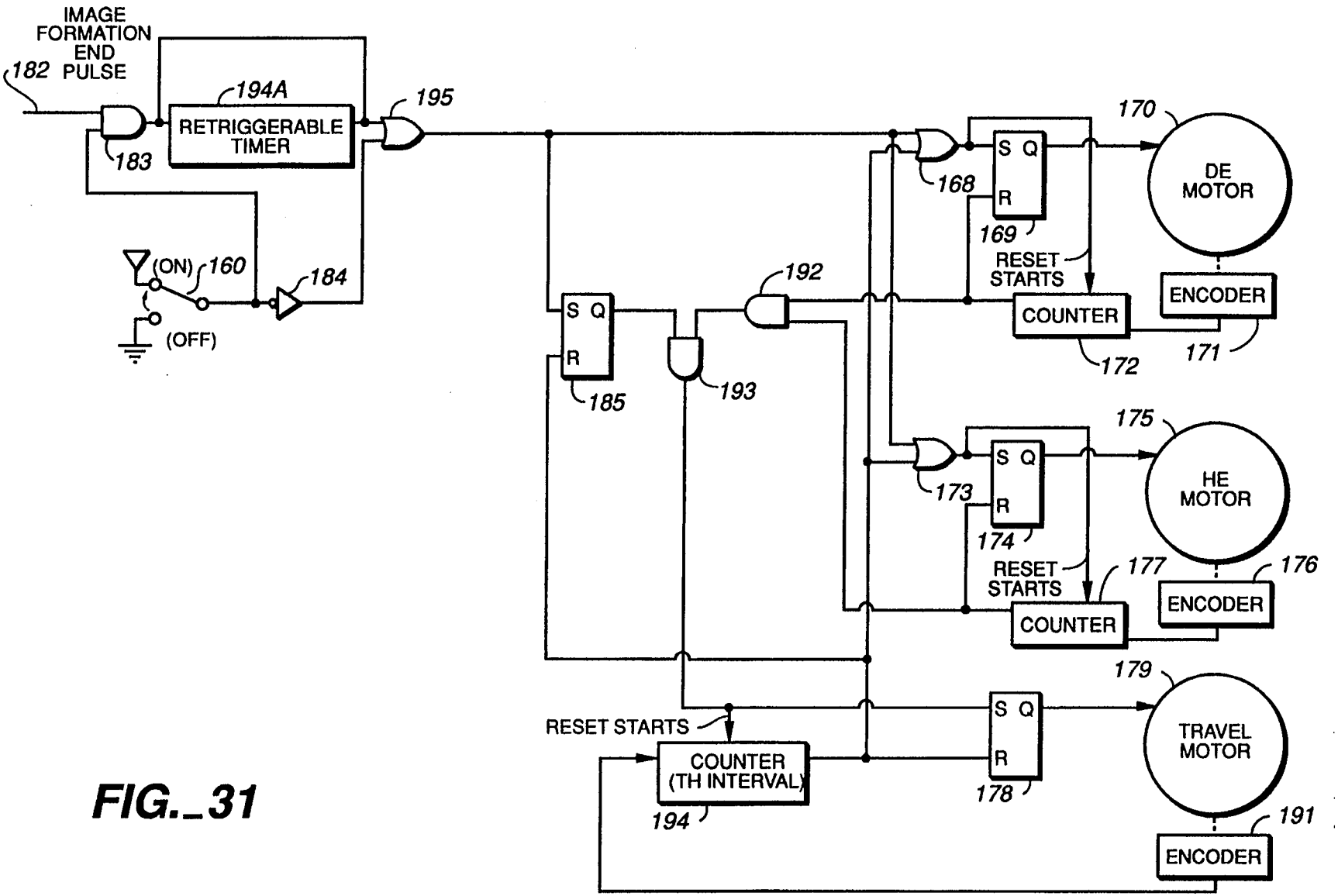
FIG. 31 is a schematic of circuits involved when the control circuit is in standby and when the power supply switch is turned off. These circuits are referred to in the method of FIG. 14.

FIG. 31 shows circuits involved with the standby and power switch turn off sequences (steps S171 to S172, and S147 to S149) that support the method of FIG. 14. The circuit components involved with this method (steps S140 to S146 of FIG. 13) are about the same as those of FIG. 25.

In FIG. 31, as in FIG. 29, during standby, retriggerable timer 194 outputs a periodic pulse. When this pulse is output and power switch 160 is turned off, the same steps as those occurring when the power switch is turned off (FIG. 27) will take place.

Figure 32:
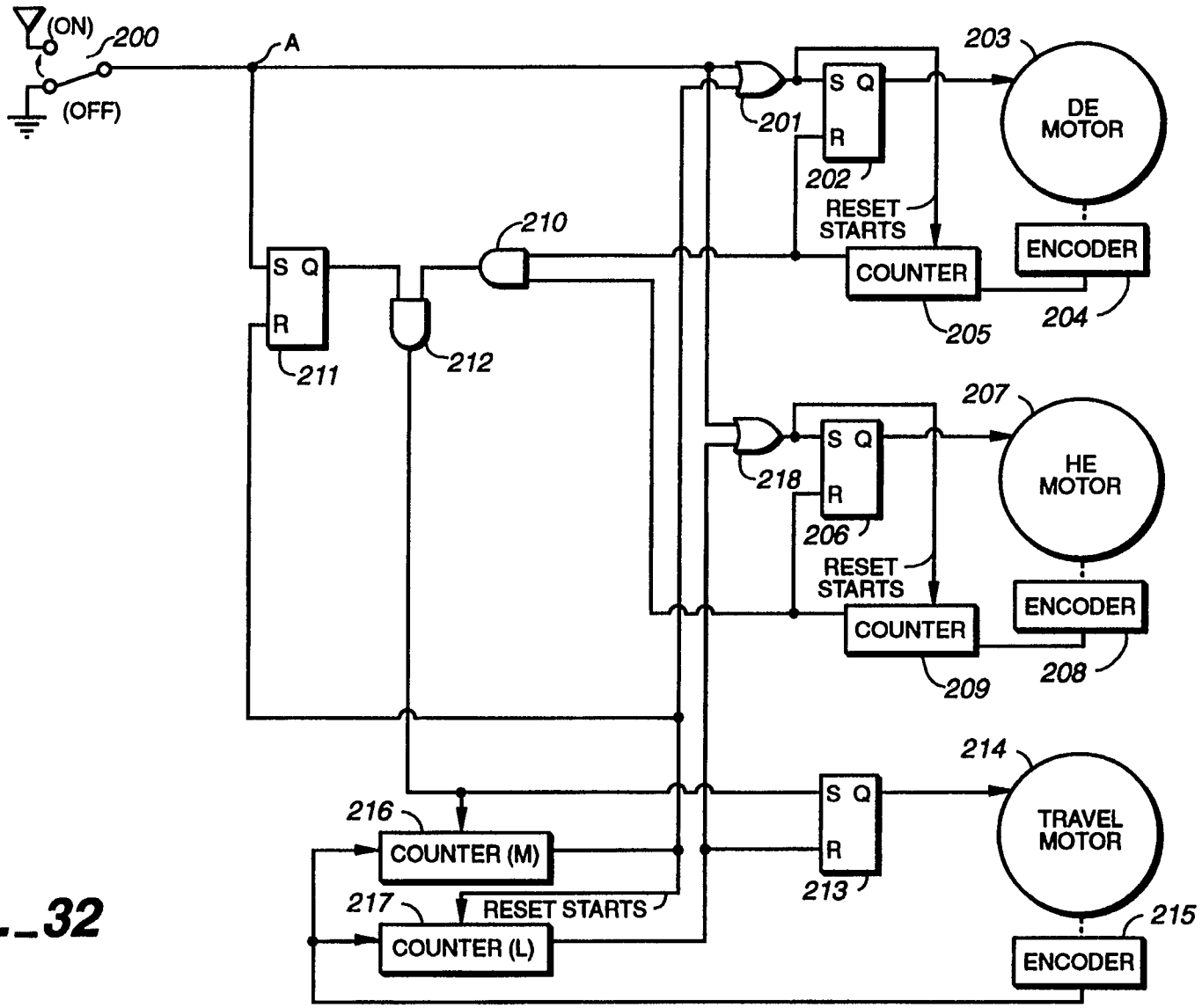
FIG. 32 is a schematic of circuits involved in the sequences of FIGS. 16 and 18.

FIG. 32 shows a control circuit supporting the method of FIG. 16. In FIG. 32, when power switch 200 is turned on, flip-flop circuits 202 and 206 are set, and ink feed mechanism De and heat roller He are moved to their respective operating positions. When the steps have been completed, an output signal from AND gate 212 goes high . This sets flip-flop 213 and starts transport motor 214. When transport motor 214 has moved the continuous-belt ink sheet one complete cycle, length M, an output signal from counter 216 goes high, setting flip-flop 202 and returning ink feed mechanism De to its standby position.

Concurrently, counter 217 starts. When the continuous-belt ink sheet travels again and reaches distance L, an output signal from counter 217 goes high. The result is flip-flop 213 is reset and transport motor 214 is stopped. Flip-flop 206 is set and heat roller 44 is returned to its standby position.

Figure 33:
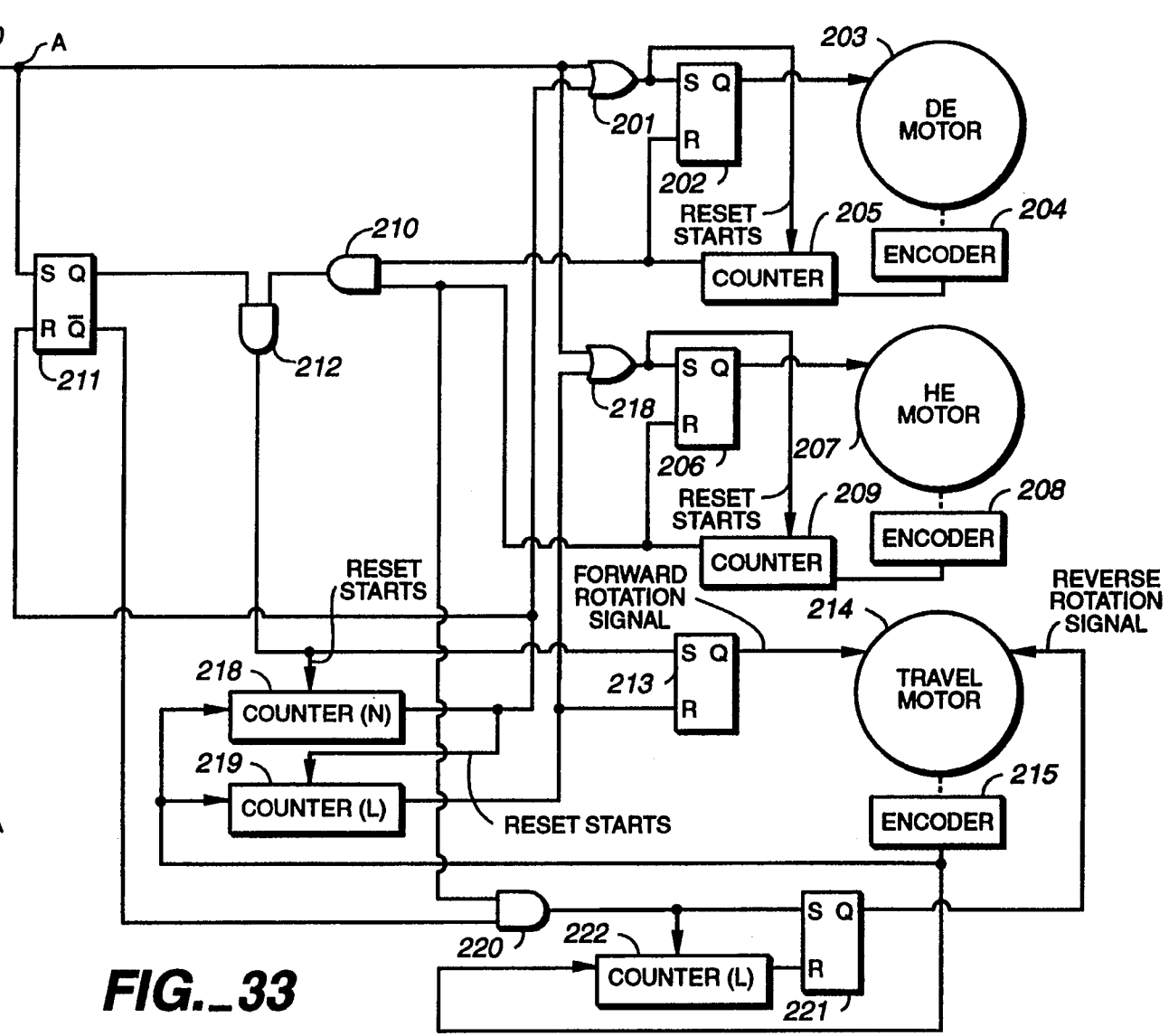
FIG. 33 is a schematic of circuits involved in the sequence of FIG. 18.

FIG. 33 shows an exemplary control circuit for supporting the method of FIG. 18, as in FIG. 33, when power switch 200 is turned on, ink feed mechanism De and heat roller He move to their operating positions and transport motor 214 starts. When transport motor 214 has moved the continuous-belt sheet distance, N, an output signal from counter 218 goes high, setting flip-flop 202 and returning ink feed mechanism De to standby mode.

Then, the continuous-belt sheet is moved length L and an output signal from counter 219 goes high, causing flip-flop 206 to set and heat roller He to return to its standby position. Concurrently, flip-flop 211 resets and an output signal from AND gate 220 goes high, setting flip-flop 221. This causes transport motor 214 to move backwards, starting the continuous-belt sheet to move backwards. When this reverse movement reaches distance L, the output of counter 222 goes high and flip-flop 221 resets, stopping the continuous-belt sheet.

Figure 34:
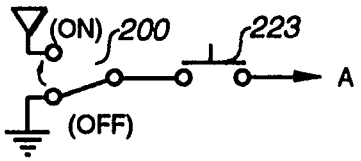
FIG. 34 is a variation of the circuits of FIGS. 32 and 33.
Figure 35:
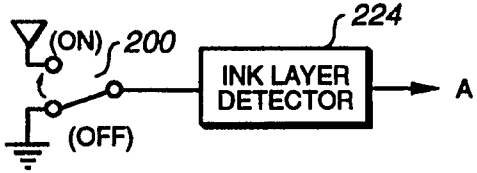
FIG. 35 is a further variation of the circuits of FIGS. 32 and 33.

Power switch 200, in FIGS. 32 and 33, may be replaced by the alternative circuit of FIG. 34 or FIG. 35. When the circuits of FIG. 34 is used, power switch 200 can turn on only when manual momentary switch 223 is also depressed. Then the method of FIG. 16 or FIG. 18 be executed. Momentary switch 223 can also be used as the ink layer formation request switch when rejuvenating an ink sheet that has no ink. Alternatively, when the circuit of FIG. 35 is used and power switch 200 is turned on, ink layer detector 224 checks for an ink layer on the continuous-belt ink sheet. If an ink layer is not detected, ink layer 224 outputs 224 outputs a pulse signal and the sequence in FIG. 16, or FIG. 18, is executed.

The control circuits diagrammed here for use in support of the printer control methods can be accomplished by a microprocessor or other computer. There are many embodiments of the present invention that have not been described here. But what has been described is exemplary of these other embodiments. Therefore, the present invention is not limited to only the above described embodiments. Variations within a range that do depart from the substance of the present invention also fall within the scope of the present invention.

What is claimed is:

1. A method of rejuvenating an ink sheet in a printer employing a continuous form-type ink sheet and a thermal printing element to form images on an output medium using ink thermally transferred from the ink sheet, comprising the steps of:

detecting when a portion of the ink sheet has been used by the print element;

transporting of predetermined length of the used ink sheet portion past a deposition means forming a layer of conductive, magnetically responsive powder ink on the predetermined length ink sheet portion;

thermally treating the formed powder ink layer to fix the powder ink to the predetermined length ink sheet portion providing a rejuvenated portion on the ink sheet;

transporting said rejuvenated portion to the printing element to a starting position at the print element for reuse.

2. A thermal transfer type printer having an elongated continuous ink sheet and an sheet rejuvenation system for use in conjunction with said ink sheet comprising:

an electrically conductive and magnetically responsive powder ink for rejuvenating said ink sheet, a plurality of stations, said stations comprising an ink deposition station for selective transfer of said powder ink to a surface of said ink sheet when a bias is applied at said deposition station, an ink fixing station for fixing said powder ink to said ink sheet, and a printing station having a thermal print head for engagement of said print head with said ink sheet onto surface of an output medium for forming images on the output medium by means of selective thermal transfer of ink to the output medium surface in imagewise formation, transport means for moving said ink sheet through said stations along a transport path;

deposition means at said deposition station to selectively transfer said powder ink to regions of a surface of said ink sheet void of said ink;

fixing means at said station for fixing said selectively transferred ink to said ink sheet surface;

said deposition means comprising:

an ink reservoir for holding a supply of said powder ink;

a powder ink delivery element positioned adjacent to said ink reservoir and having magnetic means for attracting and magnetically retaining said powder ink on an outer surface of said delivery element, said delivery element being rotatable in a predetermined direction to present a layer of said powder ink formed on said delivery element surface to said ink sheet surface transported in said transport path;

regulator means spatially positioned adjacent to said delivery element surface to regulate the amount of said ink powder formed on said delivery element surface;

an agitator rotatably supported in said ink reservoir, said agitator having outwardly extending means to position said ink powder in proximity to said delivery element surface for magnetic transfer of said powder ink to said delivery element, said agitator positioned upstream from said regulator means relative to said predetermined direction, and switch means at said deposition station for selectively providing between application of an electrostatic bias on said delivery element to cause said ink powder layer on said delivery element to selectively transfer to only those regions of said ink sheet requiring ink rejuvenation by overcoming the holding magnetic attraction of said delivery element, and application of absolute ground of said printer on said element to block transfer of said ink powder layer on said delivery element.

3. The thermal transfer type printer of claim 2 wherein said ink sheet is initially void of ink, said deposition means transferring said powder ink to the entire area of said ink sheet so that said ink sheet is rejuvenated for subsequent utilization during a printing operation at said printing station.

4. A thermal transfer type printer having an elongated continuous ink sheet and an ink sheet rejuvenation system for use in conjunction with said ink sheet comprising:

a plurality of stations, said stations comprising an ink deposition station for selective transfer of powder ink from a powder ink supply means to a surface of said ink sheet when a bias is applied at said deposition station, an ink fixing station for fixing said powder ink to said ink sheet, and a printing station having a thermal print head for engagement of said print head with said ink sheet onto a surface of an output medium for forming images on the output medium by means of selective thermal transfer of ink to the output medium surface in imagewise formation, transport means for moving said ink sheet through said stations along a transport path;

deposition means at said deposition station to selectively transfer a conductive, magnetically responsive powder ink to regions of a surface of said ink sheet void of said ink;

fixing means at said fixing station for fixing said selectively transferred ink to said ink sheet void regions so that said ink sheet is rejuvenated for utilization during a printing operation at said printing station, detecting means for determining a specified length of said ink sheet transported by said transport means; and control means for activating said ink deposition means and said ink fixing means in response to either a power ON condition or a power OFF condition applied to said printer to rejuvenate said ink sheet specified length.

5. The thermal transfer type printer of claim 4 wherein said specified length comprises a portion of a total length of said ink sheet, a total length of said ink sheet, or a length of said ink sheet between said ink deposition station and said ink fixing station.

6. A thermal transfer type printer having an elongated continuous ink sheet and an ink sheet rejuvenation system for use in conjunction with said ink sheet comprising:

a plurality of stations, said stations comprising an ink deposition station for selective transfer of powder ink from a powder ink supply means to a surface of said ink sheet when a bias is applied at said deposition station, an ink fixing station for fixing said powder ink to said ink sheet, and a printing station having a thermal print head for engagement of said print head with said ink sheet onto a surface of an output medium for forming images on the output medium by means of selective thermal transfer of ink to the output medium surface in imagewise formation, transport means for moving said ink sheet through said stations along a transport path;

deposition means at said deposition station to selectively transfer a conductive, magnetically responsive powder ink to regions of a surface of said ink sheet void of said ink;

fixing means at said fixing station for fixing said selectively transferred ink to said ink sheet surface so that said ink sheet is rejuvenated for utilization during a printing operation at said printing station, and control means for activating said transport means to move said ink sheet in response to a power ON condition applied to said printer to operate said ink deposition station and said ink fixing station until at least a portion of said ink sheet has been rejuvenated prior to activation of a printing operation at said printing station and thereafter terminating activation of said transport means upon completion of rejuvenation of said at least ink sheet portion until said printing operation is initiated at said printing station.

7. The thermal transfer type printer of claim 6 wherein said activating control means further comprises means for activating said transport means to move said ink sheet in response to a power OFF condition applied to said printer to complete the fixing of selectively transferred powder ink to said ink sheet for a predetermined length comprising a portion of said ink sheet between said ink deposition station and said ink fixing station at the time said power OFF condition is applied so that said at least ink sheet portion is rejuvenated for utilization during a printing operation at said printing station when a subsequent power ON condition is applied to said printer.

8. A method of rejuvenating an ink sheet with a layer of powder ink on a continuous closed loop ink sheet transportable past an ink deposition station for selective transfer of powder ink from a powder ink supply means to an ink sheet surface when a bias is applied at the station, ink fixing station having fixing means for selective engagement with the ink sheet surface for fixing the powder ink to the ink sheet and a print station having a thermal print head for engagement of the print head with the ink sheet onto a surface of an output medium for forming images on the output medium by means of selective thermal transfer of ink to the output medium surface in imagewise formation comprising the steps of:

activating the applied bias at the ink deposition station and engaging the ink fixing means on the ink sheet surface at the ink fixing station, transporting the ink sheet beginning at a position A of the ink sheet at the ink deposition station to, respectively, transfer powder ink to the ink sheet surface and subsequently fixing the transferred powder ink to the ink sheet continuously forming a rejuvenated portion on the ink sheet, continuing transport of the ink sheet a distance M until the position A of the rejuvenated portion of the ink sheet is present again at the ink deposition station, deactivating the ink deposition station by removal of the applied bias, transporting the ink sheet a further distance L until the position A of the rejuvenated portion of the ink sheet is present at the ink fixing station, terminating transport of the ink sheet, deactivating the ink fixing station by disengaging the fixing means from the ink sheet surface.

9. A method of rejuvenating an ink sheet with a layer of powder ink on a continuous closed loop ink sheet transportable past an ink deposition station for selective transfer of powder ink from a powder ink supply means to an ink sheet surface when a bias is applied at the station, ink fixing station having fixing means for selective engagement with the ink sheet surface for fixing the powder ink to the ink sheet and a print station having a thermal print head for engagement of the print head with the ink sheet onto a surface of an output medium for forming images on the output medium by means of selective thermal transfer of ink to the output medium surface in imagewise formation comprising the steps of:

activating both the applied bias at the ink deposition station and engaging the fixing means on the ink sheet surface at the ink fixing station, transporting said ink sheet beginning at a position A of the ink sheet at the ink deposition station to, respectively, transfer powder ink to the ink sheet surface and subsequently fixing the transferred powder ink to the ink sheet continuously forming a rejuvenated portion on the ink sheet, continuing transport of the ink sheet a distance N until the position A of the rejuvenated portion of the ink sheet is at the printing station with a position B of the ink sheet at the ink deposition station, deactivating the ink deposition station by removal of the bias from the ink sheet, transporting the ink sheet a further distance L until the position B of the rejuvenated portion of the ink sheet is present at the ink fixing station, deactivating the ink fixing station by disengaging the fixing means from the ink sheet surface, transporting the ink sheet in a reverse direction a distance L until the position A of the rejuvenated portion of the ink sheet is present again at the printing station, terminating transport of the ink sheet, the distance N and L together constituting a predetermined length of the continuous closed loop ink sheet.

* * * * *